US006579438B1

(12) United States Patent
Creber et al.

(10) Patent No.: US 6,579,438 B1
(45) Date of Patent: Jun. 17, 2003

(54) MOLTEN SALT ELECTROLYTIC CELL HAVING METAL RESERVOIR

(75) Inventors: David K. Creber, Kingston (CA); Jorgen Christensen, Kingston (CA); Meine Vandermeulen, Kingston (CA); Pasquale Ficara, Verdun (CA); George C. Holywell, Kingston (CA)

(73) Assignee: Alcan International Limited, Montreal (CA)

( * ) Notice: Subject to any disclaimer, the term of this patent is extended or adjusted under 35 U.S.C. 154(b) by 0 days.

(21) Appl. No.: 09/720,248

(22) PCT Filed: Jul. 7, 1999

(86) PCT No.: PCT/CA99/00617

§ 371 (c)(1),
(2), (4) Date: Jun. 12, 2001

(87) PCT Pub. No.: WO00/03068

PCT Pub. Date: Jan. 20, 2000

Related U.S. Application Data

(60) Provisional application No. 60/092,038, filed on Jul. 8, 1998.

(51) Int. Cl.[7] ..... C25C 3/08; C25C 3/00

(52) U.S. Cl. ..... 205/367; 204/244; 204/245; 204/246

(58) Field of Search ..... 205/367; 204/245, 204/246, 247

(56) References Cited

U.S. PATENT DOCUMENTS

| | | | | |
|---|---|---|---|---|
| 3,647,673 A | | 3/1972 | De Varda et al. | 204/244 |
| 3,962,064 A | | 6/1976 | Brut et al. | 204/245 |
| 4,334,975 A | | 6/1982 | Ishizuka | 204/247 |
| 4,402,808 A | * | 9/1983 | McMonigle | 204/247 |
| 4,420,381 A | | 12/1983 | Silvilotti et al. | 204/70 |
| 4,443,313 A | | 4/1984 | Gesing et al. | 204/240 |
| 4,518,475 A | | 5/1985 | Sivilotti | 204/247 |
| 4,617,098 A | | 10/1986 | Verdier et al. | 204/68 |
| 4,740,279 A | | 4/1988 | Miller et al. | 204/68 |
| 4,944,859 A | | 7/1990 | Matsunami et al. | 204/244 |
| 5,660,710 A | * | 8/1997 | Sivilotti | 205/367 |
| 5,855,757 A | * | 1/1999 | Sivilotti | 205/367 |

FOREIGN PATENT DOCUMENTS

| | | |
|---|---|---|
| EP | 0 101 153 A2 | 5/1983 |
| EP | WO 96/33297 | 10/1996 |
| JP | 02-129391 | 5/1990 |
| RU | 487287 | 3/1976 |
| WO | WO 97/28295 | 8/1997 |

* cited by examiner

*Primary Examiner*—Donald R. Valentine

(57) ABSTRACT

An electrolysis cell (10) for producing a molten metal having a density less than a density of a molten electrolyte used for producing the metal in the cell. The cell includes a section (14) for the electrolysis of a salt of the the metal contained in a molten electrolyte to form droplets of the metal in molten form contained in the electroylte; electrodes (18) within the electrolysis section for effecting the electrolysis; a metal recovery section (15) for separation of the metal from the electrolyte to form a molten metal layer, having an upper suface, floating on an upper surface of the molten electrolyte; a tapping device for periodically removing molten metal from the cell; and a reservoir (25) for withdrawal and temporary holding of molten metal separated from the electrolyte in the metal recovery section. The reservoir has a means to remove liquid from the reservoir without permanently removing the liquid from the cell. The reservoir has a top, sides and bottom and has one or more openings in the top or sides of the container communicating with the metal recovery section. At least part of the opening (s) is maintained below the upper surface (71) of the metal layer during at least part of normal cell operations, and all of the opening(s) is kept above the upper surface of the electrolyte in the metal recovery section for at least part of the normal cell operation. The sides and bottom are otherwise closed to prevent metal or electrolyte from freely flowing between the metal recovery section and the reservoir. The cell containing such a reservoir may accommodate high rates of metal production without unduly increasing cell size or requiring high heating requirements.

26 Claims, 14 Drawing Sheets

MOLTEN SALT ELECTROLYTIC CELL HAVING METAL RESERVOIR

CROSS-REFERENCE TO RELATED APPLICATION

This application claims the priority right of provisional application Ser. No. 60/092,038 filed Jul. 8, 1998 (abandoned) by applicants herein.

TECHINICAL FIELD

This invention relates to electrolytic reduction cells for the production of molten metals from molten salts, where the molten metal density is less than that of the electrolyte, and to methods of operating such cells. More particularly, the invention relates to electrolytic reduction cells of this type having reservoirs for the collection of the molten metal produced by the cells.

BACKGROUND ART

Magnesium and, to a lesser extent, lithium metals are normally produced on a commercial scale by the electrolysis of their chloride salts contained in a heated molten electrolyte in an electrolytic reduction cell. As electrolysis proceeds, metal is produced in molten form (since its melting point is lower than the temperature of the molten electrolyte) and, being less dense than the electrolyte, the molten metal floats to the surface of the electrolyte, where it collects and is periodically removed.

Most such reduction cells contain a metal recovery section separate from an electrolysis section. The metal recovery section takes the form of a relatively quiescent section of the cell in which metal separation may proceed effectively. In most cases, a barrier or partition is provided between the electrolysis section and metal recovery section so that the separated metal in the metal recovery section, which floats on the surface of the electrolyte, is maintained out of contact with chlorine gas, the other product of electrolysis. Electrolyte is recirculated from the metal recovery section back to the electrolysis section so that there is always sufficient electrolyte for the electrolysis process. Any barrier or partition provided for this purpose generally has channels or openings below the level of the metal layer to permit such recirculation. To assist in the electrolyte circulation, some electrolytic reduction cells of this type use level control devices to control the liquid level (metal plus electrolyte) in the metal recovery section. For example, an open bottomed bell or "submarine" immersed in the electrolyte which is connected to an inert gas supply may be used, where gas pressure is used to adjust the amount of liquid stored in the bell, which thereby alters the liquid level in the cell.

Modern electrolysis cells, particularly those of the multipolar type, have high productivity, but at the same time generate excess heat which must be removed to maintain the electrolyte temperature at a constant target level. This is often accomplished using an air to liquid heat exchanger, immersed, for example, in the metal recovery section.

The productivity of such multipolar cells has been increased to the point that either the capacity of the metal recovery section must be increased to allow for the storage of more metal between periodic metal removal operations (metal tapping), or alternatively, the frequency of metal removal must be increased. Neither of these solutions is particularly satisfactory. The provision of larger metal recovery sections would mean that cell size would be increased, thus increasing the size of metal production facilities. More frequent metal tapping results in reduced efficiency of cell operation. The very desirable gains in efficiency of metal production are therefore producing their own problems regarding plant design and operation.

Furthermore, modern electrolytic cells for the production of magnesium operate at temperatures very close to the melting point of the electrolyte in order to maximize current efficiency. This means also that the cell operating temperature lies close to the freezing point of the magnesium product. When the magnesium is collected on the electrolyte surface as in conventional cells, it can become semi-solid, or at least very viscous and difficult to tap. The conventional solution to this problem is, by some means, to heat the entire metal pad in the metal recovery section prior to tapping. This, of course, raises the electrolyte temperature and reduces current efficiency for a part of the cell operation. Heat exchangers as described above can be used to maintain the temperature at a relatively constant level, even when extra heat input is used during tapping, but in large capacity cells, the heat exchanger sizes necessary to accomplish this during and after a tapping operation become prohibitively large and expensive and require large cell sizes to accommodate them.

PCT patent publication WO 97/28295, published on Aug. 7, 1997 in the name of Olivo Sivilotti, discloses a process and apparatus for electrolysing metal chloride salts. In this patent document, metal from a metal collection section is circulated to a reservoir provided within the cell submerged beneath the molten electrolyte, and is then periodically tapped from the reservoir. The reservoir is positioned approximately centrally of the cell to ensure proper electrolyte circulation, which is associated with the particular intended method of operation of this particular cell. The central submerged reservoir is provided in order to maintain the molten metal out of contact with the refractory cell walls as much as possible, to prevent reaction with the refractory material and consequent contamination of the metal. The disadvantage of this design is that it is very specialized, complex and consequently expensive. Existing cells cannot easily be modified to accommodate this design. The central location of the reservoir tends to maximize heat equalization between the reservoir and the cell, which can result in reductions of current efficiency.

There therefore is a need for a less complex and more practical solution to the problem of increasing metal storage in metal production cells.

DISCLOSURE OF THE INVENTION

An object of the present invention is to improve the efficiency and ease of production of metal in electrolytic reduction cells where the density of the molten metal produced is less than that of the electrolyte.

Another object of the present invention is to provide a process and electrolytic apparatus for producing molten metals less dense than the electrolyte in which increased volumes of molten metal can be accommodated within electrolysis cells, particularly those with large production capacity, without having to resort to cells of much larger size, to tapping operations at much greater than normal frequency, or to the use of excessively large and expensive heat exchangers Yet another object of the present invention is to enable molten metal in electrolytic reduction cells to be kept at least temporarily at temperatures above those of the molten electrolyte without reducing cell efficiencies.

According to one aspect of the invention there is provided an electrolysis cell for producing a molten metal having a density less than a density of a molten electrolyte used for producing said metal in said cell, comprising: at least one electrolysis section for the electrolysis of a salt of said metal contained in a molten electrolyte to form droplets of said metal in molten form contained in said electrolyte; electrodes within said at least one electrolysis section for effecting said electrolysis; a metal recovery section for separation of said metal from said electrolyte to form a molten metal layer, having an upper surface, floating on an upper surface of said molten electrolyte; a liquid-filled reservoir communicating with an upper part of the metal recovery section for the collection of molten metal from said molten metal layer by overflow of said layer into said reservoir; liquid transfer apparatus communicating with said reservoir for enabling molten metal from said layer to accumulate in said reservoir by displacement of liquid already present in said reservoir, without removing said liquid permanently from said cell: and a tapping device for periodically removing molten metal from the cell. By "overflow" of the molten metal from the recovery section to the reservoir, we do not necessarily mean that the upper surfaces of the molten metal layers in these parts of the cell have different vertical levels. Indeed, these surfaces may be continuous (i.e. at the same vertical level). When this is the case, metal will nevertheless "overflow" from the recovery section to the reservoir as a result of the difference of metal layer thickness in the two parts of the cell caused by the effect of the operation of the metal transfer apparatus.

According to another aspect of the invention, there is provided a process of producing a metal, which comprises: electrolysing a salt of said metal contained in a molten electrolyte in an electrolysis section of an electrolysis cell to produce a mixture of molten metal and molten electrolyte; conveying the mixture to a metal recovery section of said cell and allowing the metal and electrolyte to separate into layers in the metal recovery section, said metal in molten form having a density that is less than the said molten electrolyte; recirculating molten electrolyte from the metal recovery section to the electrolysis section; and periodically removing molten metal from the cell; wherein the process includes providing a liquid-filled reservoir communicating with an upper part of the metal recovery section for the collection of molten metal from said molten metal layer by overflow of said layer into said reservoir and liquid transfer apparatus communicating with said reservoir, and wherein the said liquid transfer apparatus displaces liquid already present in said reservoir to enable molten metal from said layer to accumulate in said reservoir, without removing said liquid permanently from said cell.

Preferably the reservoir has a top, sides and bottom, at least one opening in said top or sides communicating with the metal recovery section, at least part of said at least one opening lying below said upper surface of said metal layer during at least part of normal cell operations, all of said at least one opening lying above said upper surface of said electrolyte in said metal recovery section for at least part of said normal cell operations, and said sides and bottom being otherwise closed to prevent the free flow of metal or electrolyte between the said metal recovery section and said reservoir.

Preferably the said at least part of said at least one opening lies below the surface of the metal layer in the said metal recovery section during all normal cell operations.

The sides of the reservoir may be formed by several adjoining side walls (e.g. as in a rectangular container) or a single continuous side wall (e.g. as in a cylindrical container).

According to another aspect of the invention, there is provided an electrolysis cell for producing a molten metal having a density less than a density of a molten electrolyte used for producing said metal in said cell, the cell comprising: at least one section for the electrolysis of a salt of said metal contained in a molten electrolyte to form droplets of said metal in molten form contained in said electrolyte; electrodes within said at least one electrolysis section for effecting said electrolysis; a metal recovery section for separation of said metal from said electrolyte to form a molten metal layer, having an upper surface, floating on an upper surface of said molten electrolyte; a reservoir for withdrawal and temporary holding of molten metal separated from said electrolyte in said metal recovery section; and a tapping device for periodically removing molten metal from the cell; wherein said reservoir is in the form of a container having at least one opening communicating with the metal recovery section, at least part of said at least one opening lying below said upper surface of said metal layer during normal cell operations, all of said at least one opening lying above said upper surface of said electrolyte in said metal recovery section for at least part of said normal cell operations, and said container being otherwise closed to prevent the free flow of metal or electrolyte between the said metal recovery section and said reservoir.

The container forming the reservoir preferably has a top, sides and a bottom. Preferably the at least one opening is in the top or sides of the container. The top may be completely open, thus forming the opening between the reservoir and the recovery section.

According to another aspect of the invention, there is provided a process of producing a metal, which comprises: electrolysing a salt of said metal contained in a molten electrolyte in an electrolysis section of an electrolysis cell to produce a mixture of molten metal and molten electrolyte; conveying the mixture to a metal recovery section of said cell and allowing the metal and electrolyte to separate into layers in the metal recovery section, said metal in molten form having a density that is less than the said molten electrolyte; recirculating molten electrolyte from the metal recovery section to the electrolysis section; and periodically removing molten metal from the cell; wherein the process includes providing a molten metal reservoir in the cell in the form of a container having at least one opening communicating with the metal recovery section, and maintaining an upper surface of said metal layer in said metal recovery section above at least part of said at least one opening during normal cell operations, maintaining an upper surface of said electrolyte in said metal recovery section below all of said at least one opening for at least part of normal cell operations, and wherein said electrolyte or said metal cannot otherwise freely flow between said metal recovery section and said reservoir.

Preferably all of the said at least one opening lies above the surface of the electrolyte for at least 80 percent of the time that the cell operates under normal cell operations. More preferably, all of the said at least one opening lies above the surface of the electrolyte during substantially all normal cell operations.

The said at least one opening may be partially above the level of both the said electrolyte and the said metal layer in the said metal recovery section during normal cell operation.

Most preferably the reservoir has a top which is completely open so that the reservoir is in the form of an open topped container having solid side walls and a solid bottom wall, wherein at least a portion of the side walls lies below the surface of the metal layer in the metal recovery section during normal cell operations, but the side walls lie entirely above the upper surface of the electrolyte in the metal recovery section during normal cell operations. A part of the side walls lies above the metal layer as well during normal cell operations, but the side walls may also be completely immersed below the top surface of the metal during normal cell operations.

The liquid transfer apparatus which displaces liquid in the reservoir most preferably does so without removing the liquid from the cell at all (even temporarily). However, temporary removal of the liquid may be desired in some cases for convenience, e.g. the liquid may be routed outside the cell from one point in the cell to another. Hence the displacement of liquid from the reservoir may be routed via a path within the cell or passing temporarily outside the cell. Preferably the liquid transfer apparatus is operable only during the portion of normal cell operations in which part of the said at least one opening lies below the surface of the metal in the metal recovery section.

The liquid transfer apparatus may be, for example, a bell or submarine within the reservoir connected to an external gas supply, where the gas pressure can be adjusted to displace liquid from the reservoir into the bell or submarine. It is particularly preferred that the liquid transfer apparatus draw liquid from the reservoir and return it to the metal recovery section. A pump will generally be used to accomplish this. Such a pump can be of any form compatible with the cell environment. A gas lift pump or impeller driven draft tube may be used. A pump in which liquid is alternately drawn into and expelled from a chamber by means of application of vacuum and gas pressure, and the flow is controlled using check valves may also be used. It is also possible to use centrifugal pumps for such an application. The pump may feed a secondary storage reservoir or surge volume or similar container from which it is flows back into the metal recovery section. Preferably, the liquid in the reservoir is displaced or removed from a point at least half way down the reservoir and most preferably from at or near the bottom.

Normal cell operations refer to cell operating conditions that occur during the major portion of time the cell operates, and excludes start-up and shut-down operations, and short perturbations to metal and electrolyte levels that may be associated with tapping or metal from the cell or adding electrolyte and metal salt.

The tapping device is preferably a syphon for metal removal and is used to remove metal from the reservoir. Pumping devices including centrifugal pumps and pumps operating by cyclical suction and pressure may also be used to remove metal from the cell.

The metal to which the invention is applicable is preferably one of magnesium, lithium, sodium, calcium and mixtures thereof. Most preferable the metal is magnesium.

Preferably the electrolysis section and metal recovery section are separated by means of a partition or barrier which prevents the gaseous products of electrolysis from entering the metal recovery section and which has openings to permit circulation of electrolyte.

The function of the molten metal reservoir is to temporarily store more metal from the cell than can conveniently be held in the metal recovery section as a layer floating on the molten electrolyte. The reservoir may form an integral or internal part of the cell or be separate from it. If separate from the cell, it may be in the form of an insulated container attached to an outer wall of the cell. The insulated container may be a refractory container or a steel container with an insulating material on its surface. However, the reservoir is preferably an integral or internal part of the cell and is positioned immediately adjacent to or within the metal recovery section and separated from it only by a wall or walls (normally a wall or walls of the reservoir itself). The bottom wall of the reservoir is preferably positioned considerably vertically below the normal uppermost position of the molten electrolyte in the metal recovery section so that the reservoir acts as a "well", i.e. a storage area into which the molten metal can flow to a depth greater than that achievable in the metal recovery section. This allows the metal storage capacity to increase without undue increase in the overall size of the cell. To provide for maximum storage capacity it is advantageous to position the bottom wall of the reservoir at the bottom of the metal recovery section, and in certain embodiments, the bottom of the metal recovery section may form the bottom wall of the reservoir. In fact, the metal reservoir may be divided out from the metal recovery section of an existing cell by building a suitable separating wall across an end or a corner of the former metal recovery section. It may also be in the form of a box within the metal recovery section without any common walls with the metal recovery section. This reduces the volume of electrolyte available for the cell, but not sufficiently that operation is impaired or that normal circulation of electrolyte between the metal recovery section and the electrolysis section is significantly affected. In all cases, it is advantageous to position the reservoir in a portion of the metal recovery section where the electrolyte flow is relatively quiescent. This typically will be at a point distant from the channels or passages communicating with the electrolysis sections. Whilst the reservoir may lie within the metal recovery section or be divided out from it by use of dividing walls, it is operationally distinct from it in that while the metal recovery section is used to separate the small droplets of molten metal from the electrolyte to form a layer on the surface, the reservoir is used to collect some or all of this already formed layer and to retain it prior to tapping. The cell otherwise works in the same way as a conventional cell not having a molten metal reservoir.

By collecting the metal in such a reservoir, the metal does not cool as readily by radiation. Because any additional heat required to heat the metal prior to tapping is applied in a more confined space, the thermal effects on the cell are reduced permitting smaller heat exchangers to be used.

The reservoir can be made from any material compatible with the cell environment. Steel may be used and because during normal cell operations the reservoir operates with a similar hydrostatic head inside and out (any head difference being caused only by the difference in the relative levels of metal to electrolyte inside the reservoir and outside the reservoir) the reservoir geometry can be chosen to optimize space without the necessity to reinforce or specially design the reservoir to overcome possible collapse at high temperatures. Steel is advantageous as well in that a removable reservoir can be thereby constructed to permit the reservoir to be periodically removed from the cell for servicing or replacement.

When the metal reservoir is positioned immediately adjacent to the metal recovery section using a separating wall to divide off part of the metal recovery section for this purpose, it is advantageous if the common wall separating the reservoir and the metal recovery section should form no more than a minor portion (i.e. less than about half) of the exterior vertical walls of the reservoir. This provides minimum area to transfer excess heat to the metal recovery section when the metal in the reservoir is heated immediately prior to periodic tapping.

It may be further advantageous to provide a wall between the reservoir and the metal recovery section having insulating qualities, such as fused cast alumina, alumino-silicate or any material such that the wall is resistant to the molten metal and electrolyte, to further limit the transfer of heat. An insulation factor in the range of 1 to 10 W/m° C. is normally suitable for this purpose although this depends on cell design and operating temperatures, etc. This is particularly useful when it is desired to minimize the heat exchanger requirements for temperature control. The refractory wall may be present either as a dividing wall as described above, or as a lining on the inside or outside of a steel container.

Of course, heating of the electrolyte in the metal recovery section by the metal in the reservoir can be avoided altogether by physically separating the reservoir from the metal recovery section. Nevertheless, this is usually not preferred. By positioning the reservoir adjacent to the metal recovery section, heat from the metal recovery section gradually passes through the interconnecting wall (even if it is made of insulating refractory) to keep the metal in the reservoir at a melting temperature without additional heating. The insulating nature and/or limited exposure of the interconnecting wall, however, protects the electrolyte from the occasional and brief increases in temperature of the metal that may be needed prior to tapping.

During operation, as metal is produced in the electrolysis section, it is carried to the metal recovery section where it separates to form a metal layer or "pad" on the surface of the electrolyte. During periods of operation where the opening or openings between the reservoir and metal collection section lie below the metal level, metal flows into the reservoir as well. In operation, the reservoir will be filled with metal and electrolyte in differing proportions depending on the tapping cycle. Liquid, which is generally electrolyte, is removed from the bottom portion of the reservoir. This electrolyte may be removed either to a submarine or bell positioned within the reservoir or may be pumped into the metal recovery section. This causes more metal to flow into the reservoir, resulting in a greater depth of metal in the reservoir than in the metal recovery section. When the reservoir contains an amount of metal suitable for tapping, the metal is preferably heated 20 to 50° C. above the electrolyte temperature and metal is siphoned from the reservoir. As the metal is siphoned off, liquid is returned to the reservoir, either from the submarine or bell or by overflow from the metal recovery section or from a combination of the two. This liquid may be metal or electrolyte or a combination of the two. Once tapping is completed, the procedure is repeated.

When a submarine or bell is used, the electrolyte in the reservoir may not contact and mix with the electrolyte in the metal recovery section to any substantial extent or at all. This means that the electrolyte composition in the reservoir may differ from the electrolyte composition in the rest of the cell. This can occur through natural changes (e.g. through changes in the magnesium chloride levels), or may be done deliberately (e.g. to provide a different melting point).

The reservoir is designed so that the only portions of the reservoir which freely communicate with the metal recovery section are the openings in the top or sides specifically located with respect to the metal and electrolyte top surfaces described above. Any openings in the sides or bottom which permit free communication between the reservoir and the metal recovery section and which do not meet these requirements will cause the apparatus to fail to collect metal as required and are therefore to be avoided. For example, an opening in the side or bottom which is always below the electrolyte top surface and permitting free communication between the metal recovery section and the reservoir will not permit proper operation of the reservoir. However, certain openings which permit liquid flow in only one direction (for example by use of check valves) and which do not therefore permit metal and electrolyte to freely flow between the reservoir and metal recovery section, may be used without affecting the operation of the apparatus and may be useful in certain types of pumps used to transfer electrolyte from the reservoir to the metal recovery section.

In certain modes of operation, it is possible for the liquid levels in the metal collection section to be low enough that the opening or openings to the reservoir lie above the metal in the metal collection chamber. As metal is produced, the level rises and eventually the metal can flow into the reservoir at which point the liquid removal from the reservoir can be commenced. It is undesirable to operate the means for liquid removal from the reservoir if there is no liquid communication with the metal recovery section because the liquid level imbalance so produced can cause operational difficulties including distortion of the walls of the reservoir. It is preferred, for simplicity and better overall control of operations, to operate the cell with a part of the opening or openings always submerged beneath the surface of the metal in the metal recovery section. This is most conveniently assured by means of a level control device operating in the metal recovery section. This level control device may be a bell, or submarine (similar to the device which may be used in the reservoir for temporary storage of liquid).

During start up of cells of this type, the reservoir will be typically filled with electrolyte. This may be done by adding electrolyte to the reservoir directly as the rest the cell is filled with electrolyte, or by raising the electrolyte level in the metal recovery section temporarily to allow the electrolyte to overflow into the reservoir. If a submarine or bell is used in the reservoir, this filling will preferably be done with the submarine or bell filled with pressurizing gas.

The advantages of the invention are that the capacity of electrolysis cells to store molten metal between tapping operations is increased without substantially increasing the floor space required for such cells and without reducing the current efficiency of the cell during normal operation.

BEST MODES FOR CARRYING OUT THE INVENTION

The apparatus of the present invention may, in preferred embodiments, take the form of a modification of an otherwise conventional magnesium reduction cell of any type having a metal recovery section formed by a metal collection section in which metal droplets in the electrolyte mixture from an electrolysis section are allowed to float to the surface and coalesce to form a floating layer of molten metal. The modification involves the formation of a metal reservoir linked to the metal collection section and the provision of equipment within the reservoir and/or within the metal collection section to enable molten metal to be withdrawn into the reservoir, heated (if necessary) and periodically removed.

Figure 1:
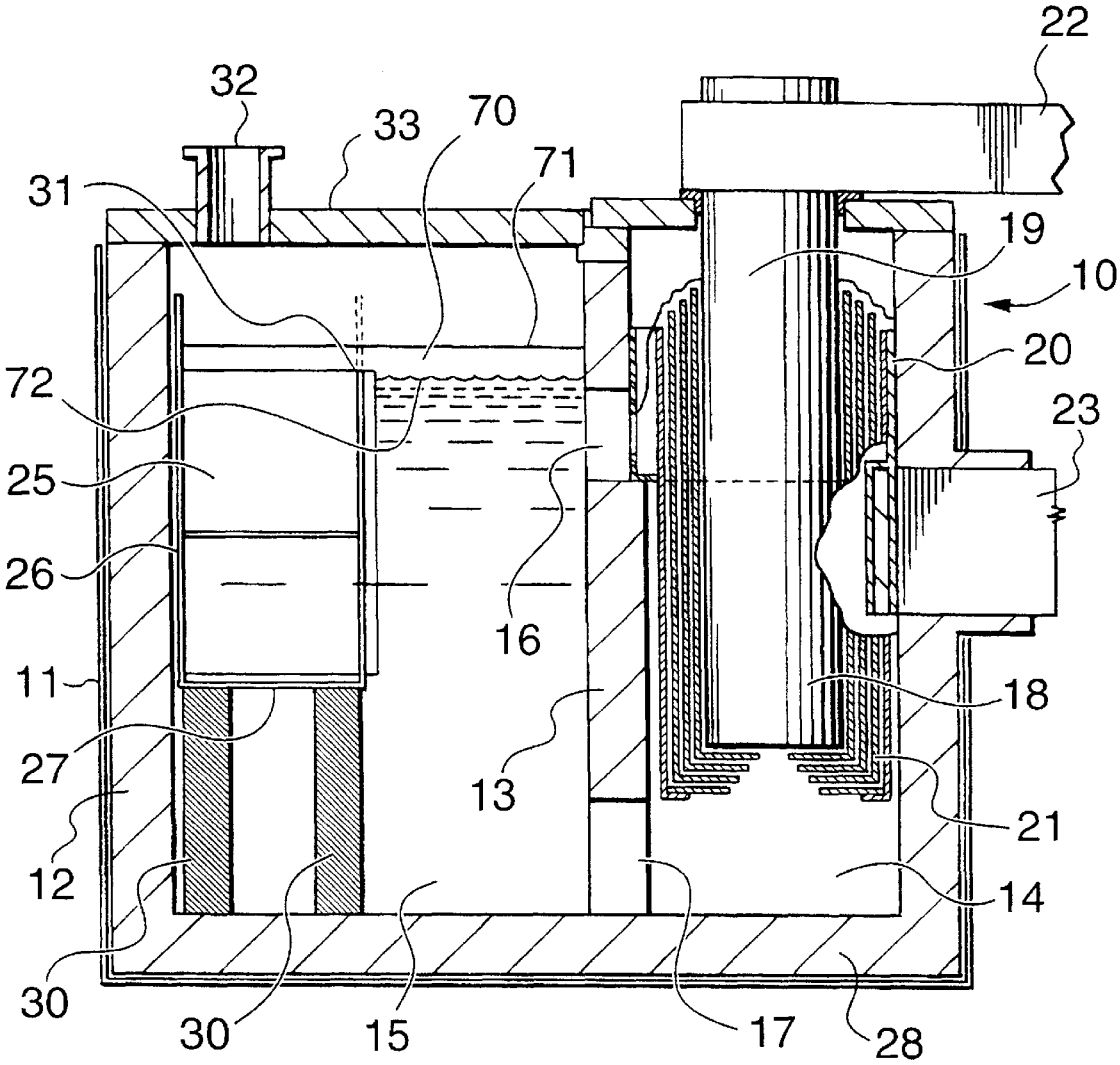
FIG. 1 is a vertical cross-section of an electrolytic reduction cell of a first kind modified to include one embodiment of a metal collection reservoir suitable for use in the present invention.
Figure 2:
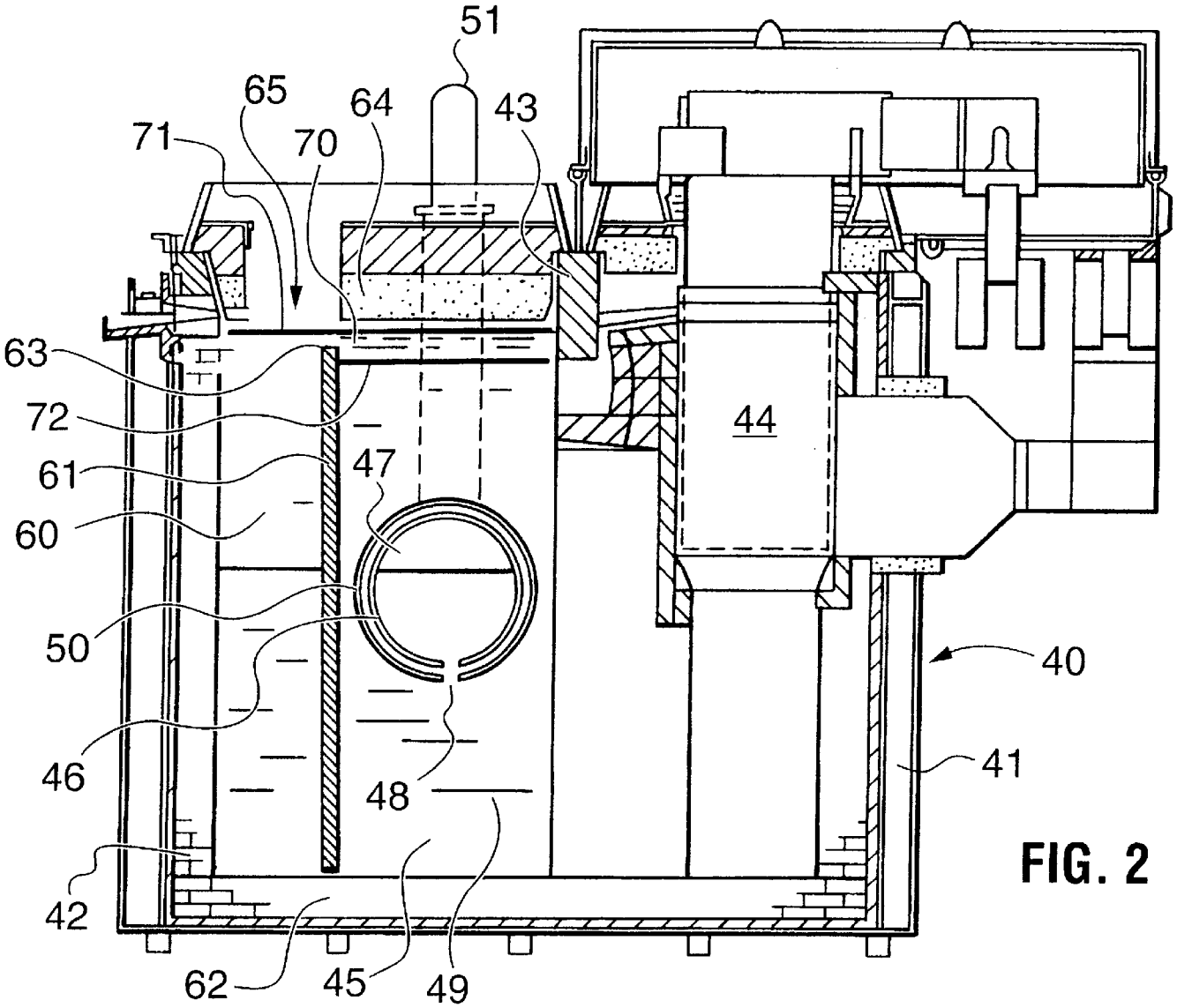
FIG. 2 is a vertical cross-section of an electrolytic reduction cell of a second kind modified to include second embodiment of a metal collection reservoir suitable for use in the present invention.

Examples of structural modifications of conventional cells are shown in FIGS. 1 and 2. FIG. 1 shows a vertical cross-section of a multipolar electrolysis cell 10 in the form of a steel shell 11 lined on the inside with a refractory material 12. The cell is divided into two sections by a refractory wall 13 to produce an electrolysis section 14 and a metal recovery section 15. The refractory wall 13 has upper and lower openings 16, 17 to permit electrolyte to circulate between the sections 14 and 15. Within the electrolysis section 14 are one or more electrode assemblies 18, each consisting of an anode 19, a cathode 20 and one or more bipolar electrodes 21. Electrical connections 22 and 23 are provided for the anode and cathode, respectively.

Unlike a conventional cell of this kind, the cell contains a molten metal reservoir 25 in the form of an at least partially open-topped rectangular space (described as a "well") divided out of the metal recovery section 15 by a steel box-like structure having side walls 26 and a bottom wall 27. The box may also be constructed from insulating refractory materials or from steel sheet lined or surfaced by insulating refractories. The reservoir occupies one end of the rectangular cell 10 but is separate from it (has no walls in common). In this embodiment, the bottom wall 27 of the reservoir 25 lies significantly above the bottom wall 28 of the metal recovery section 15, and supporting pillars 30 are provided to ensure stability. One portion 31 of the side walls 26 is lower than the rest of the side walls. Generally this will be a portion facing the metal recovery section. An access port 32 is provided in the top 33 of the cell for tapping of metal from the reservoir.

The metal recovery section 15 may contain a liquid level control device (not shown) to maintain the liquid levels relatively constant during most stages of operation. Further details of electrolysis cells of this type (without the reservoir) may be found, for example, in international PCT patent publication WO 96/33297 (Sivilotti et al.) published on Oct. 24, 1996.

FIG. 2 shows a vertical cross-section of a second type of multipolar electrolysis cell 40. The cell in this embodiment is again in the form of a metal shell 41 having a refractory lining 42 internally divided by a refractory wall 43 at the upper level of the cell into an electrolysis section 44 and a metal recovery section 45. A liquid-level controlling device 46 is contained in the metal recovery section 45 and consists of a hollow chamber 47 provided with an opening 48 in the bottom communicating with the liquid electrolyte 49 in the metal recovery section 45 and which is connected by means of a pipe to an external source of inert gas (not shown). The chamber is surrounded by a sealed jacket 50 through which air is passed, from an external blower (not shown). This air enters through pipe 51, and exits through a second pipe not shown in this Figure.

The cell has been modified to include a molten metal reservoir 60 which has been divided out of the metal recovery section 45 by a solid refractory wall 61 extending from the floor 62 of the cell up to an upper edge 63 near the top of the cell 64 to form the reservoir 60. Thus, the reservoir is in the form of a well with the top surface completely open, and the side walls formed in part by the wall 61 and in part by a portion of the cell refractory walls 42, and the bottom formed by a portion of the cell floor 62. An access port 65 is provided in the top of the cell 63 to provide access to the reservoir 60. Other features of multipolar cells of this type (except for the reservoir 60) are described in U.S. Pat. No. 4,518,475 to Sivilotti issued on May 21, 1985.

Both of the cells of FIG. 1 and FIG. 2 operate in similar ways to produce magnesium metal. Current is passed through the electrode assembly(ies) via electrolyte contained between the electrodes. Magnesium metal is produced at the cathode and at the cathodic surfaces of bipolar electrodes, and chlorine gas is produced at the anode and at the anodic surfaces of the bipolar electrodes. The chlorine gas causes the magnesium-droplet-containing electrolyte to rise in the inter-electrode gaps to the tops of the electrode assemblies where the electrolyte overflows, passes under the barrier wall or through a hole in the top portion of the barrier wall and enters the metal recovery section. This action causes the chlorine gas to separate from the electrolyte and remain in the top of the electrolysis section, from where it is extracted, and causes the metal droplets to be carried across into the metal recovery section where they float to the top surface of the electrolyte to form a metal layer 70. Electrolyte is returned from the metal recovery section to the electrolysis section by openings in the lower portion of the dividing wall of the cell (FIG. 1) or under the lower edge of a hanging divider wall (FIG. 2).

In the case of the embodiment of FIG. 2, to maintain the flow of electrolyte at an optimum level, the level control device 46 is provided. The pressure of inert gas in the device is adjusted to permit electrolyte to enter or to be expelled from the hollow chamber 47 in the device to maintain liquids at the desired target level in the cell during normal operations and to compensate for salt depletion and metal production. Such devices may also be used in the embodiment of FIG. 1, or a level control device integral with the cathode assembly 20 may be used. Such a device is described in PCT application WO 96/33297 (Sivilotti et al.).

In all embodiments of the present invention, the cell is operated so that the lowest part of the upper edge (31 in FIG. 1, 63 in FIG. 2) of the side walls of the reservoir lies below the upper surface 71 of the metal within the metal recovery section during at least some part of normal cell operation. The liquid levels may fluctuate during the operation of some cell designs between tapping and feeding cycles, and the reservoir can be operated provided that the level of liquids is maintained so that the lowest part of the upper edge of the side walls is below the upper surface of the metal sufficiently often that metal produced can flow over the edge and into the reservoir. However, it is particularly preferred that the lowest portion of the upper edge of the side walls lie below the upper surface 71 of the metal during substantially all normal cell operations. This can be assured most conveniently by means of a liquid level control device 46 of the type described in connection with FIG. 2.

In all embodiments of the present invention, the cell is operated so that the lowest part of the upper edge of the side walls lies above an interface 72 between the metal and the electrolyte during a portion of the normal cell operations and preferably for a substantial portion of normal cell operations (e.g. 80%—or even more preferably, all normal cell operations). Only when the upper edge lies above the interface 72 will the reservoir operate effectively to collect metal and, therefore, this preferably should occur for most of the time the cell is in operation.

FIGS. 1 and 2 show the provision of molten metal reservoirs (25 in FIG. 1, 60 in FIG. 12) in different kinds of cells. However, additional equipment is included in order to make the apparatus of the invention work in the intended manner. The details of this additional equipment will be described in the following with reference to FIGS. 3 to 6. It should be noted, however, that this additional equipment may be used with the cell of FIG. 1, the cell of FIG. 2, or any alternative kind of cell having a metal recovery section and metal reservoir.

Figure 4:
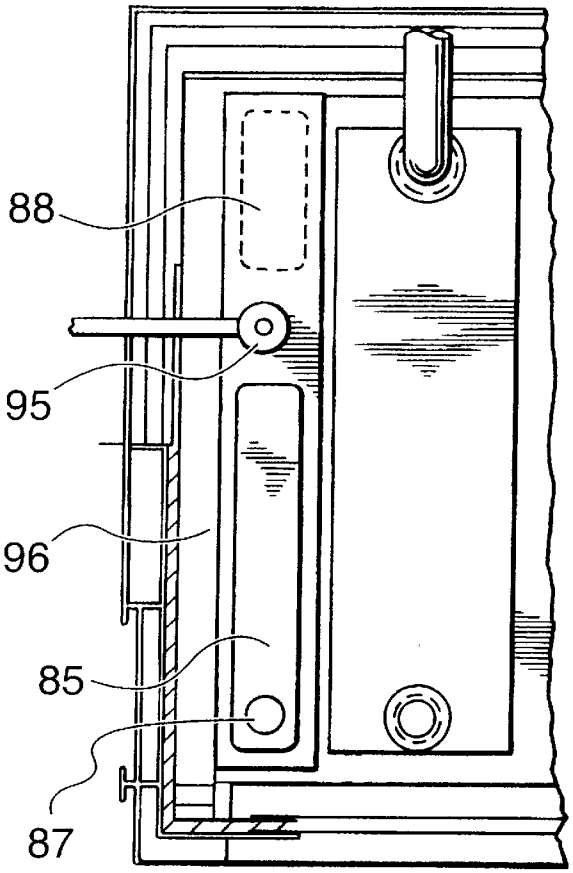
FIG. 4 is a horizontal cross-section of the embodiment of FIG. 3.
Figure 3:
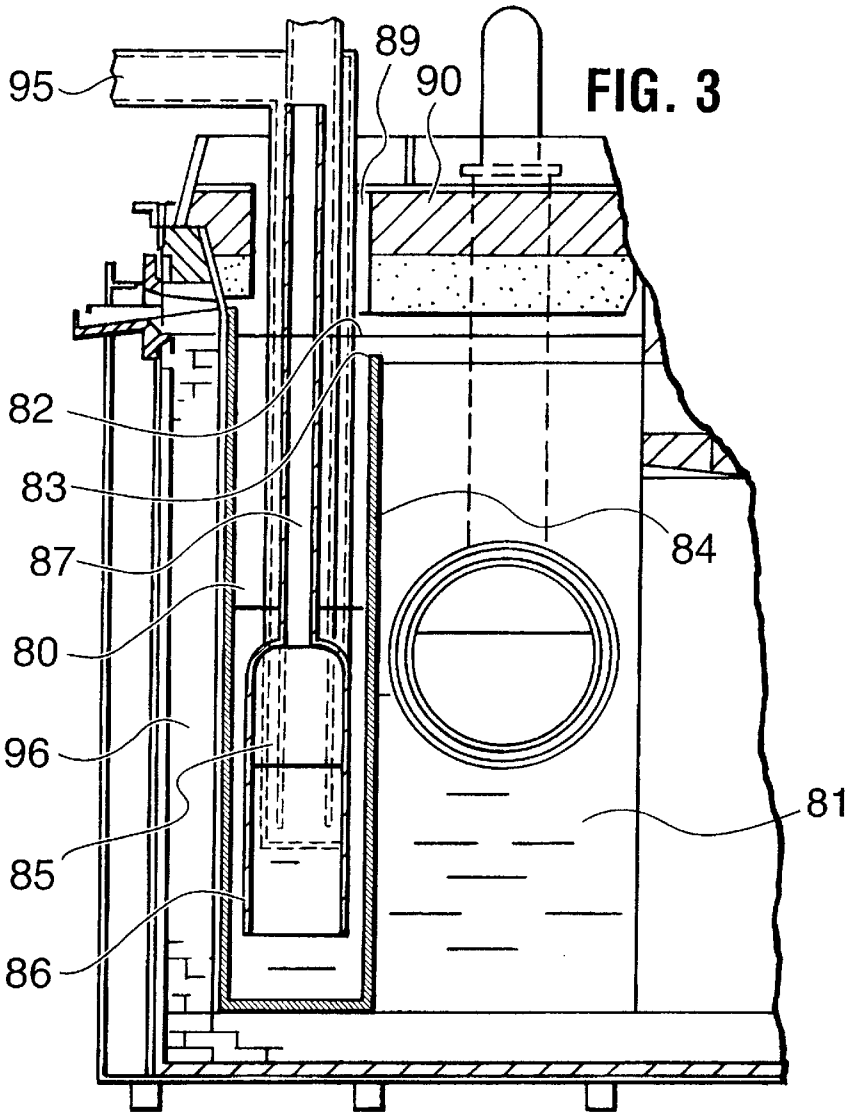
FIG. 3 is a partial cross-section of an electrolytic reduction cell showing additional apparatus forming a first preferred embodiment of the present invention.

FIGS. 3 and 4 show a reservoir 80 and a portion of a metal recovery section 81 of the type shown in FIG. 1 or FIG. 2. When the cell is in normal operation, the liquid in the metal recovery section (consisting of electrolyte and variable amounts of molten metal on the surface of the electrolyte) has a normal operating level (level of its upper surface) 82 that is maintained above the lowest part of the upper edge 83 of the side walls 84. The reservoir 80 contains a liquid storage bell (or submarine) 85 consisting of an open-bottomed but otherwise sealed inverted container 86 fed by a gas delivery pipe 87 connected to an external source (not shown) of a (preferably inert) gas, which can operate under pressure or suction. If suction is applied to the gas delivery pipe 87, then liquid (generally electrolyte) is removed from the reservoir to the interior of the container 86, and metal from the metal recovery section can enter the reservoir as the liquid is drawn from the reservoir.

The reservoir may be periodically tapped by means of a syphon (not shown), which can access the reservoir in the area 88 (see FIG. 4) via an opening 89 in the top 90 of the cell. During tapping, pressure may be applied to the gas delivery pipe 87 returning the temporarily stored liquid in container 86 to the reservoir to occupy the space held by the tapped metal, and generally to raise the metal-electrolyte interface within the reservoir in preparation for receiving more metal. The liquid storage bell is shown within the reservoir in FIGS. 3 and 4, but can be located outside the reservoir, if desired, communicating via a closed pipe which joins the lower portion of the container (now sealed to the pipe) with the lower portion of the reservoir.

An immersion heat exchanger 95 may be provided for the reservoir and may be permanently mounted in the reservoir, or inserted temporarily during tapping. if desired. Immersion heat exchangers suitable for this purpose are described, for example. in U.S. Pat. No. 4,420,381 (Sivilotti et al.) which can be used for heating as well as for cooling as described in that patent, or in Japanese Laid Open Patent Application JP 02-129391 (Maebara et al.). Alternatively, other types of heaters (for example, resistive electrical heaters immersed in the liquid in the reservoir or embedded in the refractory wall 96 of the cell adjacent the reservoir, or AC electrodes immersed in electrolyte in the bottom of the reservoir) may be used.

Although not specifically shown, all devices exiting the cell (e.g. connections to the heat exchanger, and the gas supply to the submarine), are sealed into the top of the cell 90 where they pass through. The opening provided in the top of the cell for insertion of a tapping syphon is also provided with a removable cover. Thus, the top of the cell is sealed during most of its operation and an inert gas flush is provided to prevent oxidation of the magnesium in the metal recovery section and reservoir.

Figure 5:
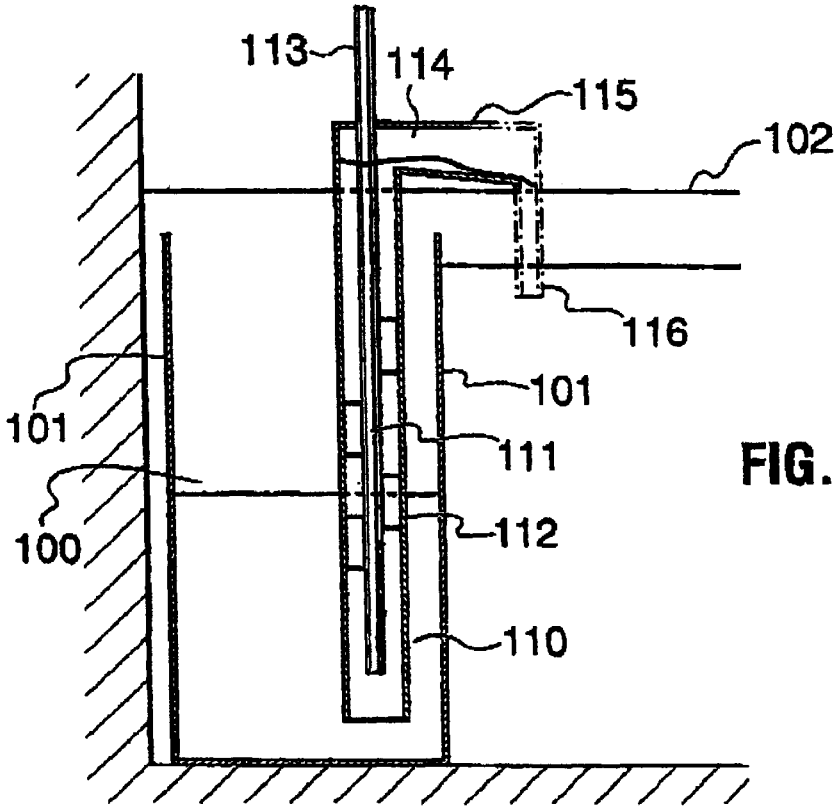
FIG. 5 is a partial cross-section of an electrolytic reduction cell showing additional apparatus forming a second preferred embodiment of the present invention.

FIGS. 5 to 9 show only a reservoir 100 contained within the metal recovery section of a cell of this invention. In FIG. 5, the side walls 101 of the reservoir 100 lie entirely beneath the top surface 102 of the metal. In FIGS. 6 to 9, only a portion 103 of the side walls 101 lie beneath the top surface 102 of the metal. Although not shown, the metal recovery section may be equipped with a level control device and heat exchanger, and the reservoir can be equipped with either a permanent or immersion type heat exchanger (i.e. as illustrated in FIGS. 2, 3 and 4). The reservoir will be tapped as in the previous embodiments.

FIG. 5 shows a gas lift pump 110 used to transfer liquid from the reservoir to the metal recovery section. The pump consists of an inner gas delivery tube 111 which is sealed into the roof of the cell (not shown) and a concentric liquid containment tube 112. A source of inert gas (not shown) is attached to the tube end 113 outside the cell. Gas is delivered to the gas delivery tube and rises up in the annular space between that tube and the concentric liquid containment tube. This causes liquid within the annulus to be carried upwards and to flow into the exit pipe 114 and to spill over at the end of the pipe where it drops back into the metal recovery section. The gas escapes at 115 and is exhausted with other normal cell gases from the metal recovery section. The exit pipe 114 may also be extended (shown by dotted lines 116) so that it terminates below the surface of the liquid in the metal recovery section. In such a case, an opening is still provided for gas to escape. Such a modification allows the liquid to discharge below the surface and reduces turbulence and splashing. The gas lift pump may be operated continuously or intermittently, but is preferably operated intermittently. The pump causes liquid (electrolyte) in the reservoir to be transferred to the metal recovery chamber and this liquid is replaced by metal permitting the reservoir to be filled with increasing amounts of liquid metal. Unlike the submarine or bell which reverses operation during tapping to return liquid to the reservoir to compensate for the metal removal, the present type of pump does not reverse, but relies on a return path for liquid over the immersed walls 101 of the reservoir 100 to return liquid (usually metal) to the reservoir, since the liquid level 102 in the metal recovery section is always higher than the walls 101. If excess metal is tapped, some electrolyte may transfer into the reservoir, but as this will be pumped out on the next cycle, this does not cause any operational problems.

Figure 6:
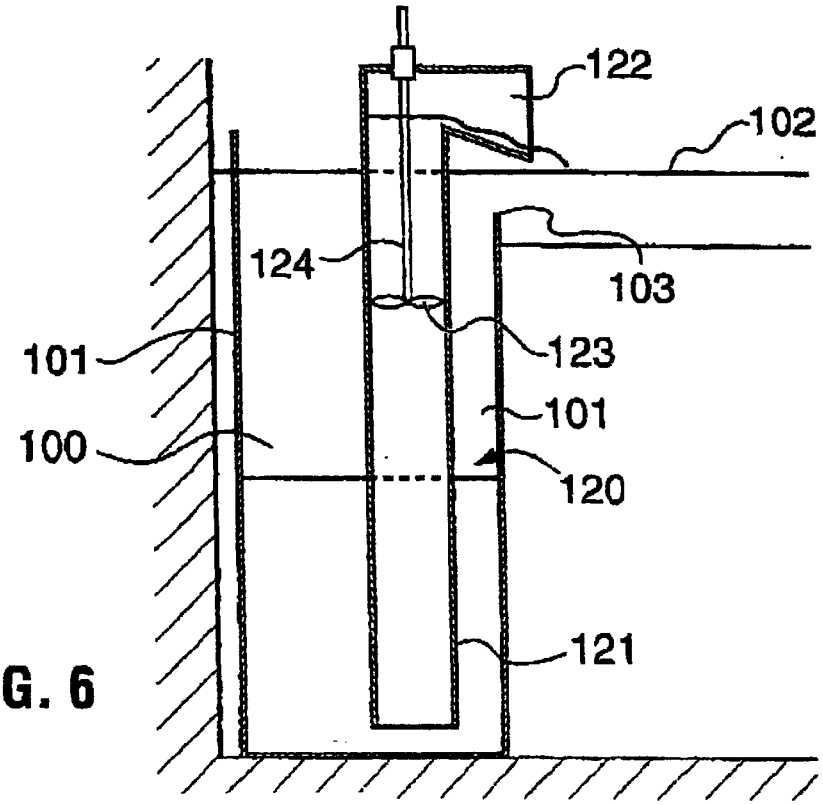
FIG. 6 is a partial cross-section of an electrolytic reduction cell showing additional apparatus forming a third preferred embodiment of the present invention.

FIG. 6 shows a draft tube liquid circulation device 120 used to transfer liquid from the reservoir. The device consists of a draft tube 121 open at the bottom, with an overflow outlet 122 discharging into the metal recovery section. An impeller 123 attached to a shaft 124 is mounted within the draft tube. The shaft passes through the top of the cell (not shown) where it is sealed by a rotary seal (not shown). The impeller is rotated by a motor external to the cell (not shown) which may be of any convenient type (for example, an electric or pneumatic motor). The impeller 123 is configured so as to cause liquid to flow upwards in the draft tube 121 and then to overflow at the outlet 122. The operation is otherwise similar to the embodiment of FIG. 5, except that the liquid return path is confined to the immersed part 103 of the walls 101 to return liquid to the reservoir 100 when the liquid is pumped from the reservoir into the metal recovery section.

Figure 7:
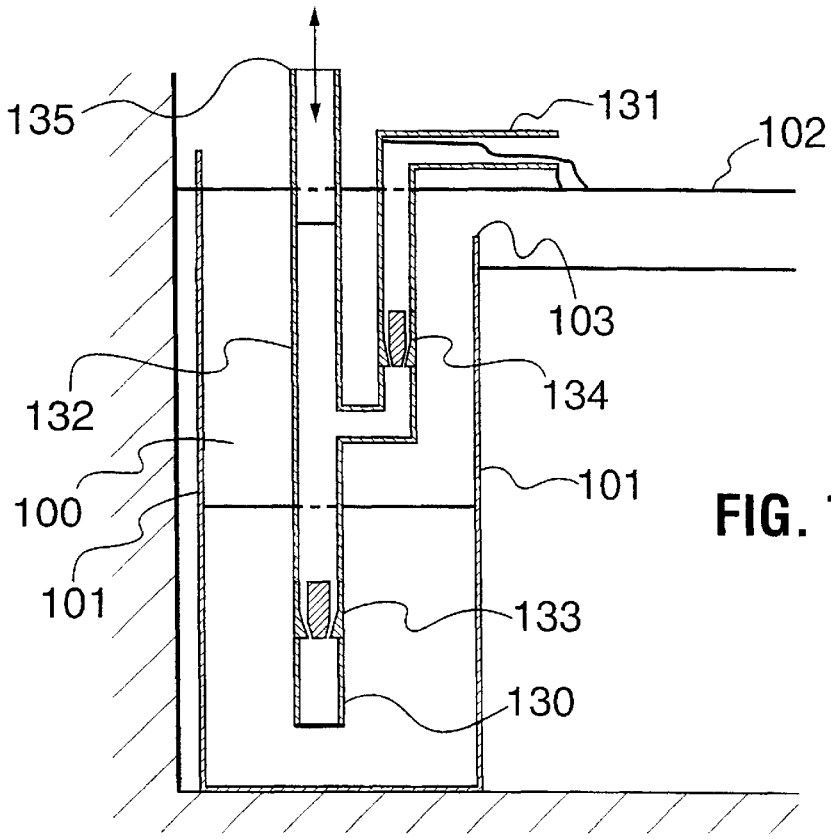
FIG. 7 is a partial cross-section of an electrolytic reduction cell showing additional apparatus forming a fourth preferred embodiment of the present invention.

FIG. 7 shows an additional pump type that can be used with the present invention. In this pump, an inlet pipe 130, and outlet pipe 131 and an holding pipe 132 are provided. The holding pipe (or a narrower diameter pipe connecting to the holding pipe) passes through the top of the furnace (not shown) and is sealed at that point. The outlet pipe discharges into the metal recovery section. The inlet pipe and outlet pipe are both equipped with one way valves 133, 134 configured so that liquid can only flow in the direction as shown. A source of inert gas is applied to the end 135 of the holding pipe 132. By applying alternate suction and pressure, liquid is first drawn upwards past the valve 133 (suction part of the cycle) and into part of the holding pipe 132, during which time the valve 134 is held closed by the weight of liquid above it. During the pressure part of the cycle, liquid is forced past the valve 134 and is discharged into the metal recovery section, while the valve 133 is held shut by the weight of liquid. This pump also otherwise operates in the same manner as that of FIG. 5 or 6.

Other pumps may also be used. For example, centrifugal pumps having an inlet immersed in the reservoir and an outlet discharging into the metal recovery section may also be used, the pump being driven by a shaft that extends upwards through the top of the cell (not shown) where it is provided with a rotary seal (not shown) and driven by an external motor (not shown).

Figure 8:
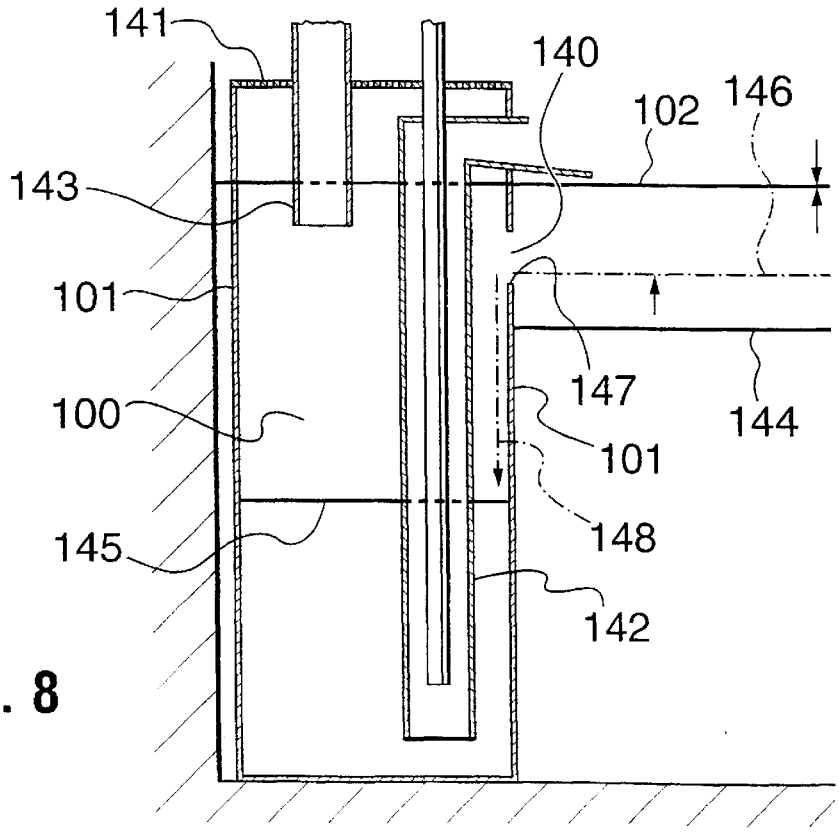
FIG. 8 is a partial cross-section of an electrolytic reduction cell showing an apparatus similar to FIG. 6, with a tapping apparatus include.

FIG. 8 shows a reservoir 100 in which an opening 140 is provided in one of the side walls 101. The opening as illustrated is shown completely immersed below the top surface 102 of the metal, although it may also be arranged to be only partially immersed if desired. The top 141 of reservoir may be completely covered except where the various apparatus such as heat exchanger, pump and siphon pass through, or may have openings as well. It is preferred that at least one opening be provided such that there is "gas" communication between the reservoir and the metal recovery section, although such an opening may be simply provided by a gap where the various apparatus pass through the top of the reservoir. A gas lift pump 142 (more fully described in FIG. 5) is also shown and the end of a tapping syphon 143 is also shown immersed below the metal level 102. The tapping crucible attached to this syphon is not shown, but is of conventional design. During normal operation except for tapping operations, the electrolyte level 144 in the metal recovery section lies below any communicating opening between the reservoir and metal recovery section. In the mode of operation illustrated in FIG. 8, the top surface 102 of the metal pad is maintained at a constant target level by use of a level control device (not shown in this Figure, but illustrated, for example, in FIG. 2). During normal operations prior to tapping, as metal is produced and separated in the metal recovery section (as described above), the upper level 102 is maintained constant or within some band about a predetermined level and the electrolyte level 144 will fall until the pump 142 draws liquid from the reservoir 100 and returns it to the metal recovery section, thus drawing metal into the reservoir 100 and causing the metal-electrolyte interface 145 in the reservoir to fall and the interface position 144 to rise. When the cell is tapped of metal, the syphon 143 draws metal from the metal layer in the reservoir and as the metal level 102 is maintained constant, the electrolyte level 144 rises further. The interface 145 however, remains at a constant level if the pump 142 is not operated during this tapping operation, or will fall further if the pump continues to operate. If sufficient metal is withdrawn by the siphon, the electrolyte level may rise to a level 146 (at or just above the lowest point 147 of the side opening 140) at which time electrolyte 148 will flow into the reservoir over the low point 147 of the opening 140 and occupy some of the space below the interface 145. This electrolyte will eventually be returned to the metal recovery section by the pump following tapping as metal again starts to build up, but it is desirable that this occur for as short a length of time as possible to prevent excessive demands on operation of the pump 140. It will be clear from this Figure that if the electrolyte remained at or above the level 146 for extended periods of time, the metal level in the reservoir would be equal to that in the metal recovery section (unless the pump 140 has a high operating capacity sufficient to at least overcome the rate of flow of the electrolyte into the reservoir) and therefore no additional metal storage would be available during those periods, and the cell would not operate in an optimal manner. It is clearly essential that any communicating openings lie above the electrolyte level in the metal recovery section for at least part of normal cell operations, otherwise the usefulness of the reservoir would be lost. It is particularly preferred that the communicating openings always lie entirely above the electrolyte level in the metal recovery section for much of the cell's normal operations (80% or more), and if possible for substantially all the cell's normal operations.

Figure 9:
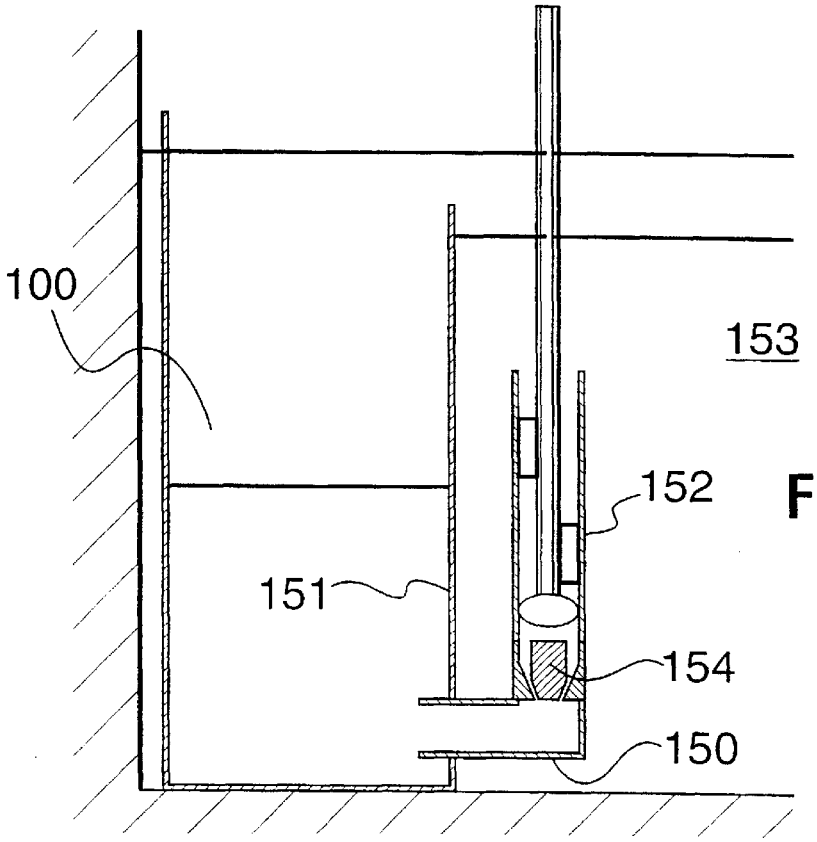
FIG. 9 is a partial cross-section of an electrolytic reduction cell showing additional apparatus forming a fifth preferred embodiment of the present invention.

FIG. 9 shows yet another pump type for use with the present invention. In this case, the pump inlet pipe 150 passes through a wall 151 of the reservoir 100. The pump 152 is a gas lift pump as illustrated in FIG. 5, for example, but the gas and liquid in this gas both discharge into the liquid in the metal recovery section 153. The gas then rises to the surface. A check valve 154 is provided so that if the pump stops operating liquid is prevented from flowing back into the reservoir. This check valve thereby prevents the electrolyte from freely flowing between the reservoir and the metal recovery section. Although a gas lift pump is shown, any of the other pumps of the present invention may be used as well. The inlet 150 of the pump can be located in the side wall 151 as shown or may even be located in the bottom of the reservoir if the container forming the reservoir is a suitable geometry (for example as shown in FIG. 1).

Figure 10:
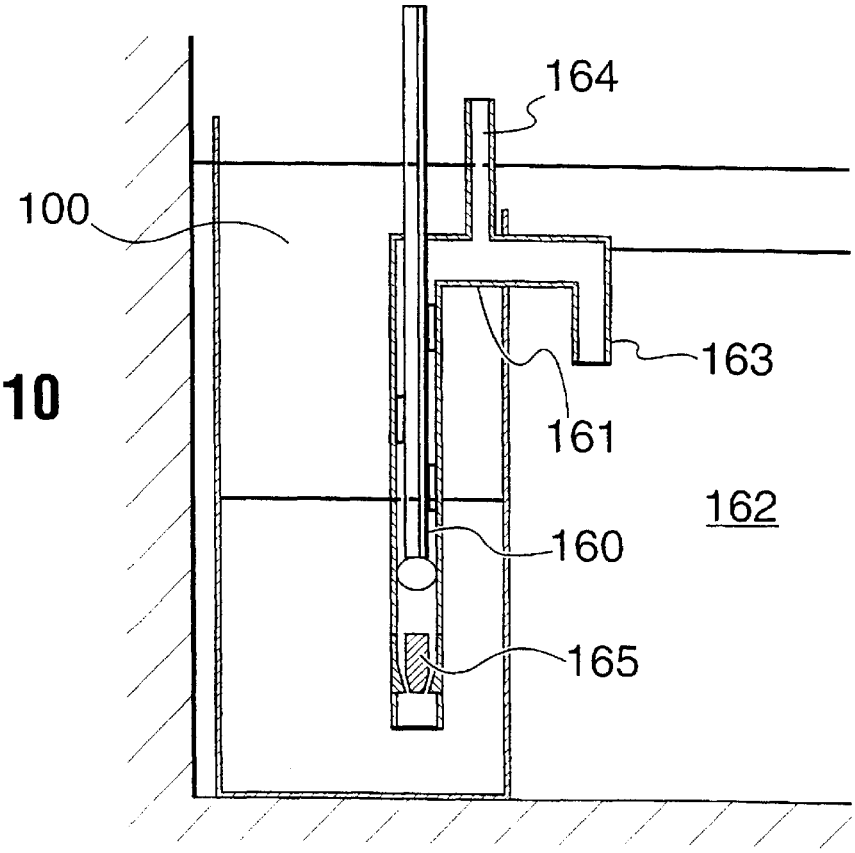
FIG. 10 is a partial cross-section of an electrolytic reduction cell showing additional apparatus forming a sixth preferred embodiment of the present invention.

FIG. 10 shows a variation of gas lift pump which may also be used with the present invention. In this case a gas lift pump 160 is provided as described in FIG. 5 except that the exit pipe 161 is totally immersed in the liquid in the reservoir 100 and metal recovery section 162. The liquid pumped is discharged into the metal recovery section by the pipe 163, and the gas used to operate the pump escapes through the pipe 164 which extends up to through the top surface of the liquid and may if desired discharge externally to the cell. A check valve 165 at the pump inlet is also provided in this case to avoid flow back of liquid if the pump stops operating. The check valve can also be located in the discharge pipe 163. Any of the pumps previously described may also be substituted for the gas lift pump.

Figure 11:
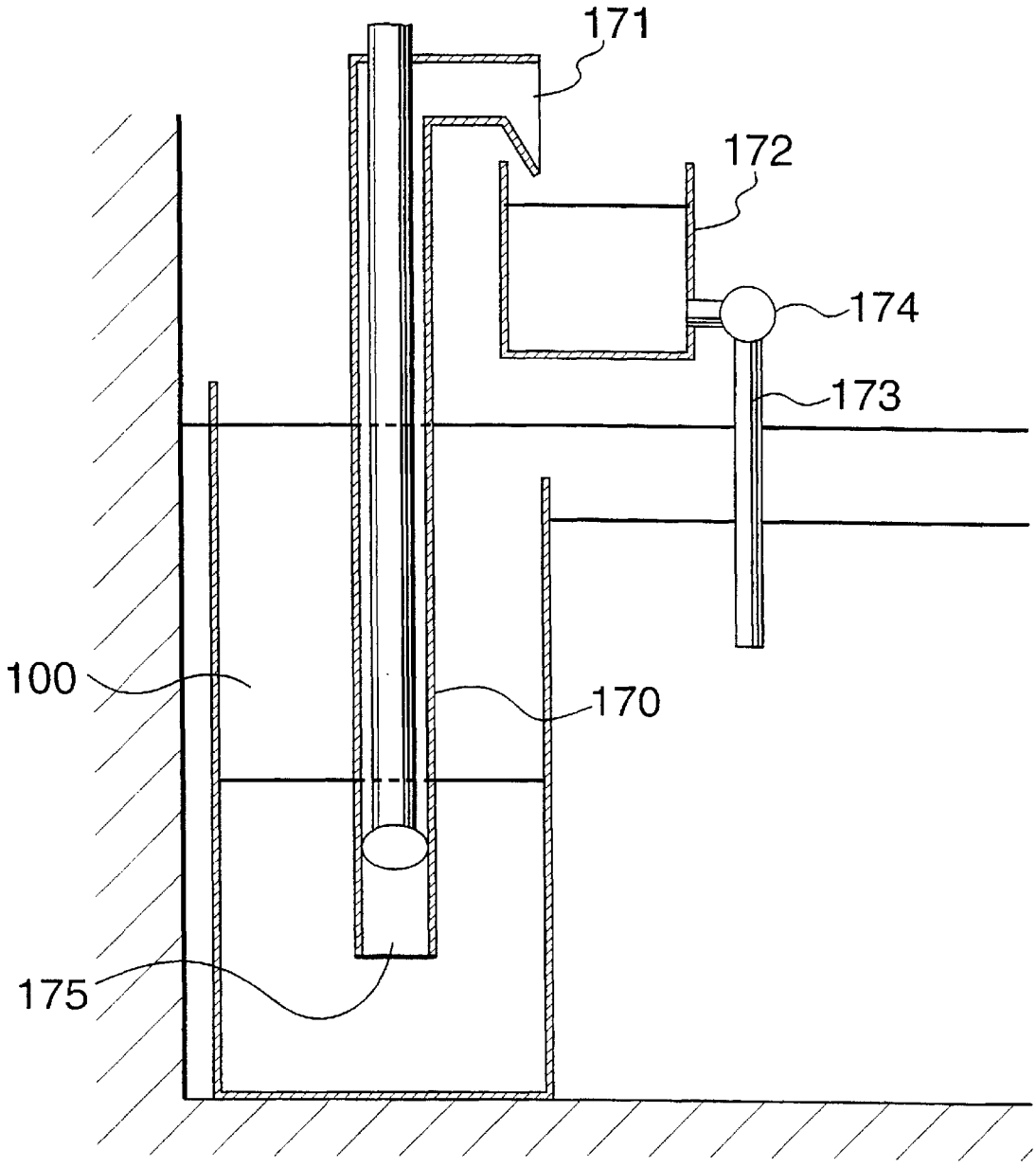
FIG. 11 is a partial cross-section of an electrolytic reduction cell showing additional apparatus forming a seventh preferred embodiment of the present invention.

FIG. 11 shows a further variation of the gas lift pump. In this case a gas lift pump 170 is provided where the exit pipe 171 discharges into a tank 172. This tank may be internal or external to the cell, and may serve, for example as-a tank for mixing additional feed into the electrolyte for use in the cell. The tank is provided with an outlet 173 having a metering pump or valve 174 to control the rate of return of the liquid to the metal recovery section. When used externally to the cell, the pump and tank must be provided with suitable heating to prevent solidification of the liquids. The inlet of the pump 175 must be located at a level in the reservoir 100 so that only electrolyte will be drawn into the tank 172. Whether or not the tank 172 is located external to the cell, no electrolyte is permanently removed from the cell during operation.

Figure 12A:
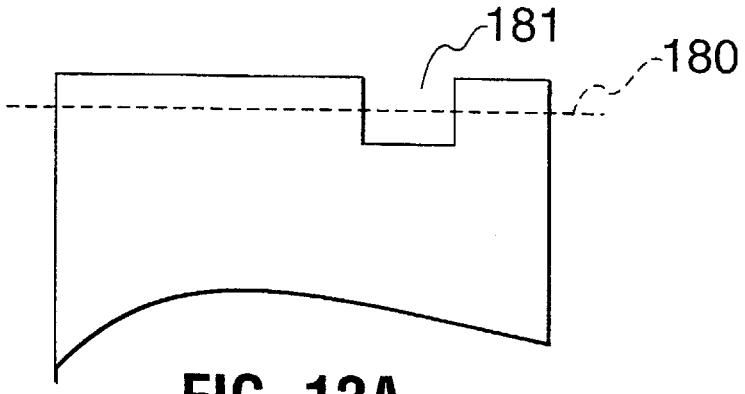
FIGS. 12A, 12B and 12C are vertical views of a side of the reservoir in the preceding embodiments, showing different forms of openings communicating with the metal recovery section.
Figure 12B:
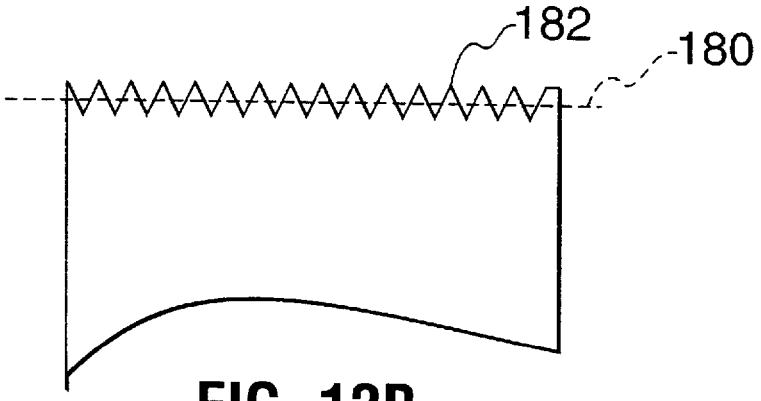
Figure 12C:
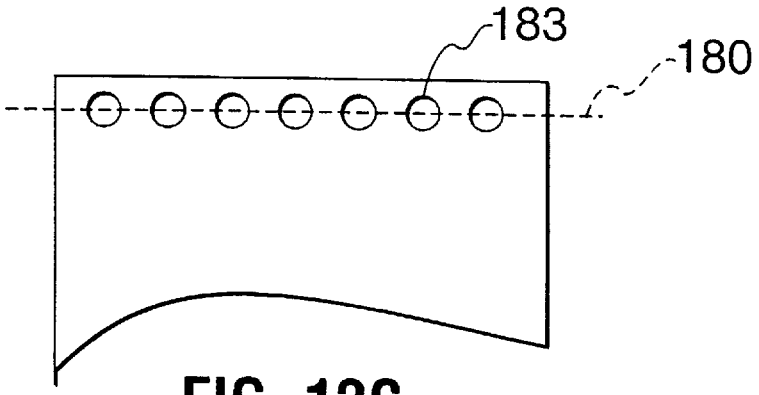

FIGS. 12*a*, 12*b* and 12*c* show a portion of the side of the reservoirs illustrated in the previous figures. Generally this is the side facing the metal recovery section. In all the figures the preferred location 180 of the top of the metal in the metal recovery section is shown (dashed line). In FIG. 12*a*, the opening in the reservoir (which may include a top opening as well) has a rectangular cutout section 181 where the opening is maintained below the top surface of the metal. In FIG. 12*b*, a series of diagonal cutouts 182 are provided for the same purpose. In FIG. 12*c*, a series of holes 183 are provided in the side so that at least of portion of these holes lies below the metal surface. The embodiment of FIG. 12*c* may be used with an open topped container or with a closed top container, for example as shown in FIG. 8. These figures are illustrative of some of the types of openings that may be used with the present invention. However, any opening configuration meeting the criteria for immersion can be used, and the selection will depend on the location of other components that may be present in a particular cell configuration.

Figure 13:
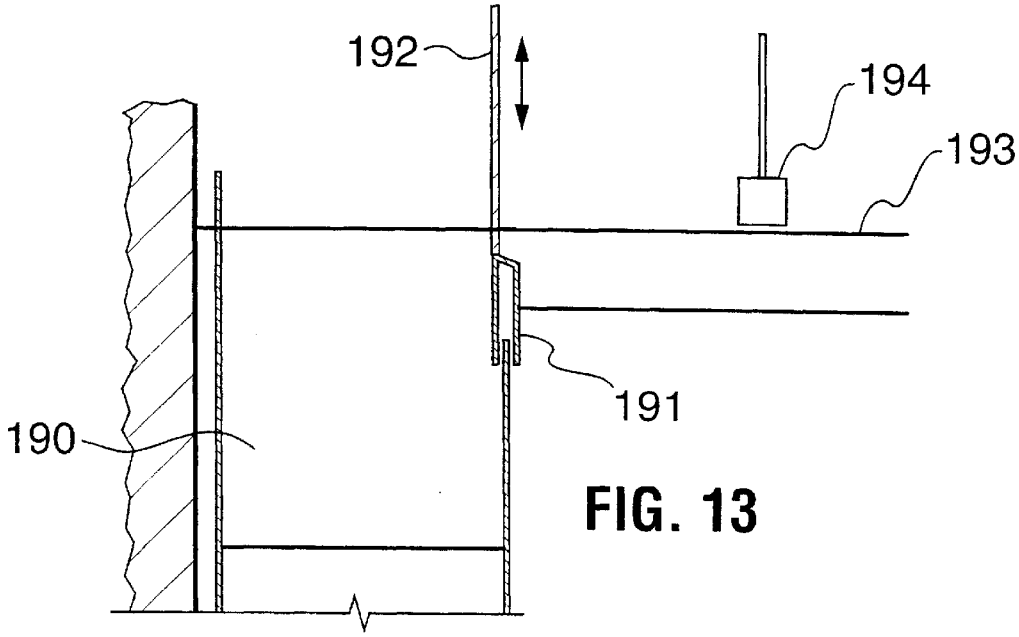
FIG. 13 is a vertical section of an electrolytic reduction cell showing a reservoir modification suitable for cells with no metal level control.

FIG. 13 shows an alternative opening design which is intended for use primarily where the position of the upper surface of the metal is not controlled. One side of the reservoir 190 is provided with a sliding wall portion 191 which is suspended from a hanger 192 which extends up through the top (not shown) of the cell where it can be raised or lower by any convenient mechanical means (a screwjack for example). The sliding wall portion 191 is free to move in the vertical direction and is moved tip or down in response to a measurement of the position of the surface of the metal 193 in the metal collection section. The position may be measured by means of a position sensor 194 (for example a laser position sensor, capacitance sensor, float, or similar means). The sliding wall portion contains an opening or openings of any suitable type (such as illustrated in FIG. 12*a* to 12*c*) and the vertical movement of the wall section ensues that at least part of the wall section and openings in it will be below the metal surface for most normal operation periods of the cell.

Figure 14:
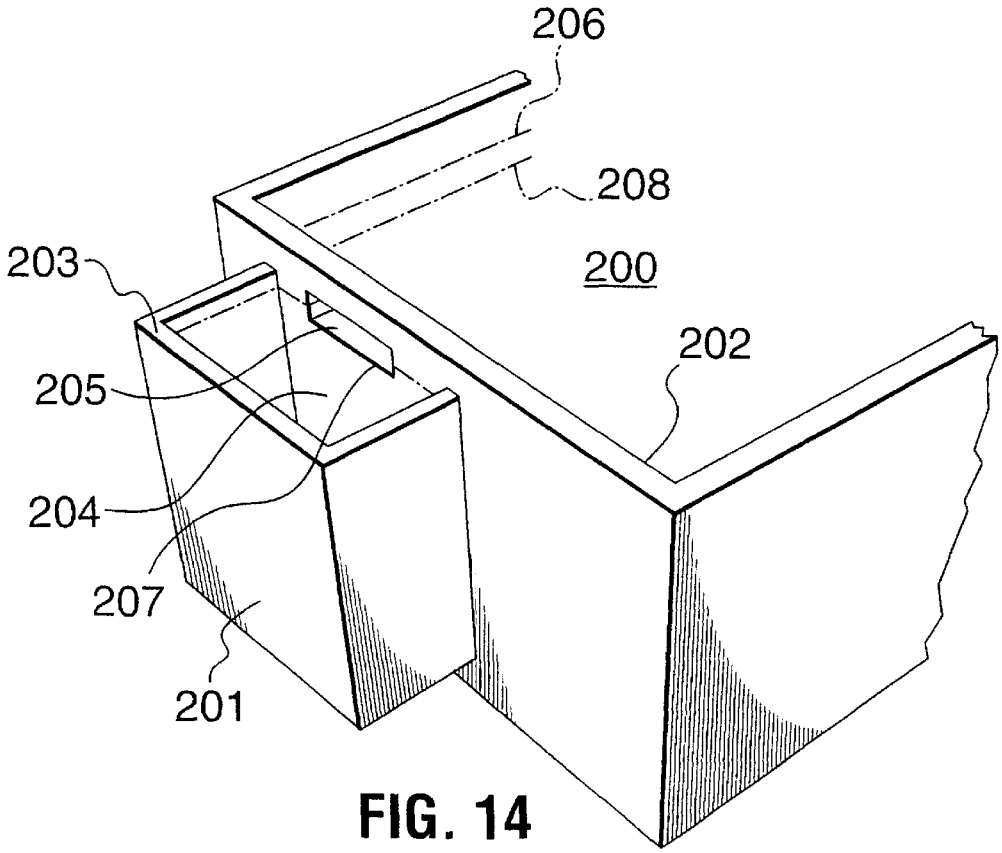
FIG. 14 is a perspective view showing a part of an electrolytic reduction cell and an externally located reservoir.
Figure 15:
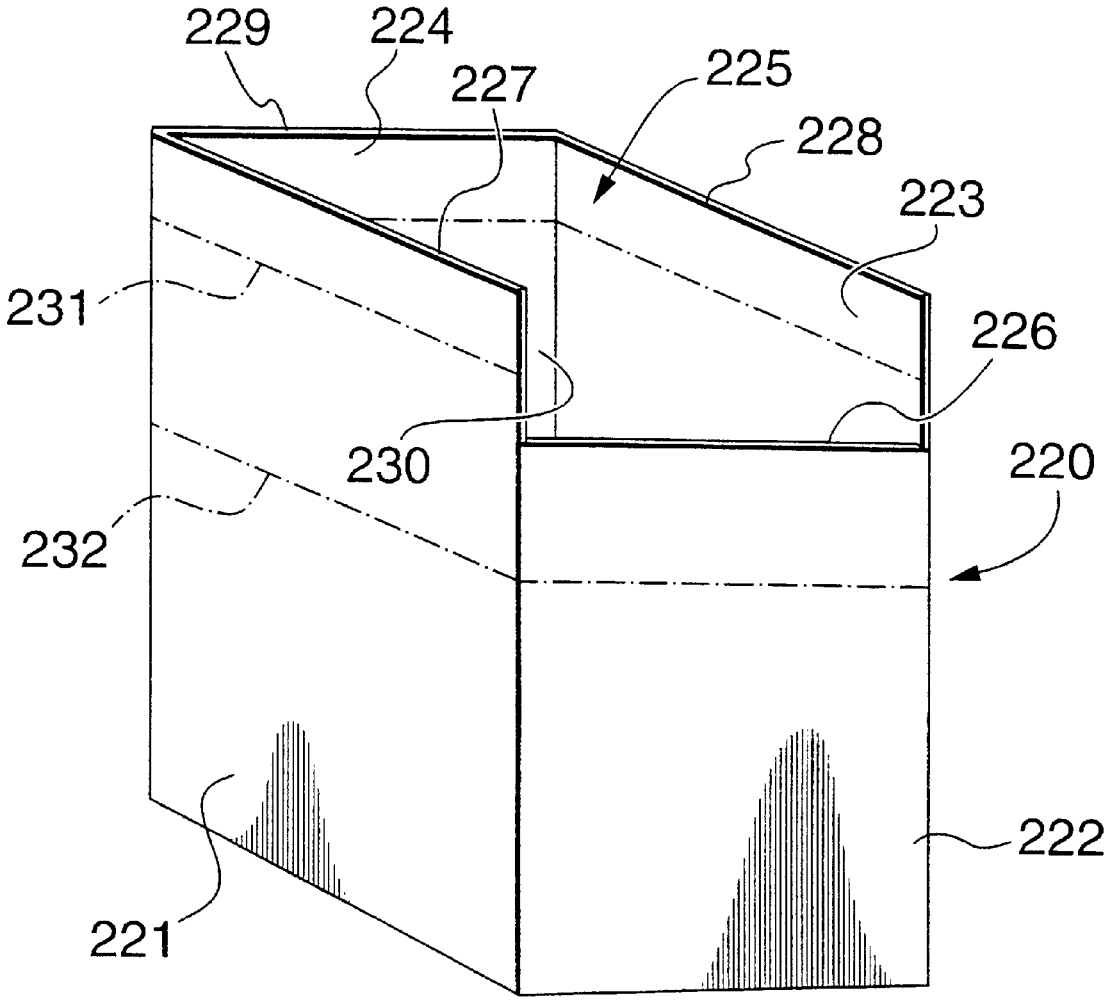
FIG. 15 is a perspective view of a reservoir of a preferred kind shown in isolation from a cell.

FIG. 14 is a perspective view of part of the metal section 200 with an "external" reservoir 201 attached The metal recovery section is contained wit a refractory lined steel wall 202, and the reservoir itself is formed from there refractory lined steel walls 203 with the outside of the metal collection section forming the closing wall 204. The steel outer section may be removed from the metal collection section for the portion forming the closing wall. The reservoir is provided with a floor (not visible in this figure) which may be at a level different from the floor of the metal collection section if desired. A passageway 205 is provided which passes through the closing wall and permits communication between the reservoir and the metal recovery section. In operation, tie metal level in the metal recovery section is maintained at a position indicated by a dashed line 206, such that the bottom 207 of the passageway 205 lies below the upper surface of the metal. The electrolyte level 208 in the metal recovery section will normally lie below the bottom 207 of the passageway, The metal recovery section and reservoir will be normally covered with gas tight refractory lined covers through which the various metal level control devices, beaters and tapping arrangements already described will pass. Either the internal submarine or pump arrangements already described will be usable with the reservoir to remove liquid from the reservoir and to return the liquid either to the reservoir to the metal recovery section FIG. 15 shows a preferred reservoir design in isolation from the cell. In this design, the reservoir 220 is an open-topped box having solid side walls 221, 222, 223 and 224, a solid bottom wall (not visible) and a completely open top 225. The side wall 222 has an upper edge 226 that is lower than the upper edges 227, 228 and 229 of the other side walls. The open space 230 above the upper edge 226 forms an opening through which molten metal may enter the reservoir from the adjacent metal recovery section (not shown). The upper level of the molten metal is indicated by line 231 and the upper level of die molten electrolyte is indicated by line 232. As will be apparent from the drawing, the upper edge 226 lies below the molten metal level 231 but above the molten electrolyte layer 232 so that only molten metal enters the reservoir.

Figure 16:
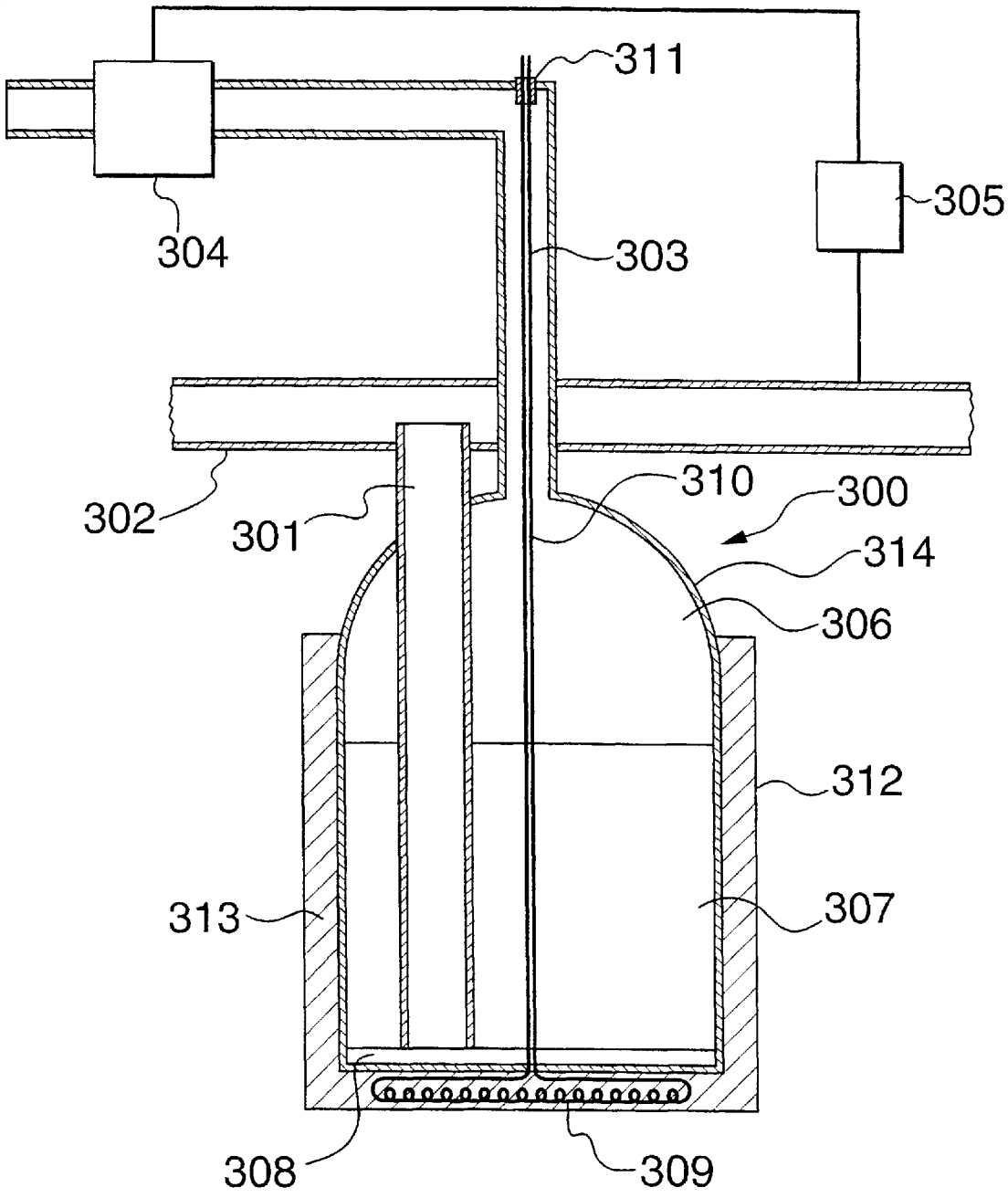
FIG. 16 is a partial cross-section of a further embodiment of the metal reservoir.

FIG. 16 illustrates a further embodiment of the metal reservoir in which the reservoir is combined with the metal level control device and therefore a single device combines both functions and permits the elimination of separate reservoirs and metal level control devices such as items 60 and 46 of FIG. 2. This reduces the space requirements within the metal recovery section of the cell. This metal reservoir 300 consists of a closed steel container 314 with a gas pipe at the top communicating with the exterior of the cell. A stand-pipe 301 is provided which extends from near the bottom of the reservoir to a point that is generally within the metal pad 302 in the metal recovery section of the cell. The external gas pipe 303 is connected to a pressure controller 304 that controls the inflow or outflow of an inert gas such as argon into a gas space 306 provided in the upper part of the reservoir. A level sensor 305 is also provided which feeds back a signal to the pressure controller such that the pressure controller admits or exhausts gas from the gas space 306 so as to maintain the upper level of the metal pad in the recovery section constant about a predefined target level. The level sensor may be any type of device suitable for measuring liquid levels in tanks or similar equipment, provided it is adaptable to the environment of a magnesium cell. Capacitance, laser devices are known or the hydrostatic pressure taken at a predetermined point below the liquid surface in the cell may all be used for this purpose.

During operation of the cell, metal is produced continuously and magnesium chloride is fed to the cell either continuously or intermittently and in order to maintain a constant upper level to the metal in the recovery section, gas is admitted or exhausted from the gas space 306 and during periods when gas is exhausted, metal flows in and collects 307 in the reservoir, displacing some of the gas. It is preferred that the magnesium chloride be fed continuously in which case the control is such that gas is exhausted more or less continuously from the reservoir as metal is produced and feeds into the reservoir. Occasionally, some electrolyte may enter the reservoir, either entrained in the metal or through temporary process upsets and this will collect in a pool 308 at the bottom of the reservoir.

It is advantageous as in other embodiments of the reservoir to incorporate heaters to heat up the metal prior to tapping. A heat exchanger fed by hot gas may be used or AC resistance heaters may be used. In the embodiment of FIG. 16, AC resistance heaters 309, fed from power cables 310 which enter via seals 311 in the gas pipe 303 are used and are contained within the interior of a steel outer jacket 312 to the reservoir. Insulation 313 may also be provided between the outer and inner jackets of the reservoir.

Metal is periodically removed from the cell by tapping from the metal pad 302 in the usual manner. This causes the upper level of the metal to start to fall, at which time gas is admitted to the gas space 306 via the pressure controller 304 and at least a portion of the metal 307 is expelled back to the metal pad 302 where it may form part of the tapped quantity. Because the stand-pipe 301 extends to near the bottom of the reservoir, if an excessive amount of electrolyte has become entrapped in the reservoir (in the layer 308 at the bottom), at least a portion of this layer will be expelled back up the stand-pipe and will be returned to the main body of electrolyte in the cell during a tapping operation. The tapping siphon may be placed with its tip anywhere within the metal pad 302, and may also be placed with its tip extending down the stand-pipe 301 at least part way. In the later case, provision for electrolyte separation from the metal external to the cell may be required to handle any electrolyte that becomes trapped within the reservoir from time to time.

Figure 17:
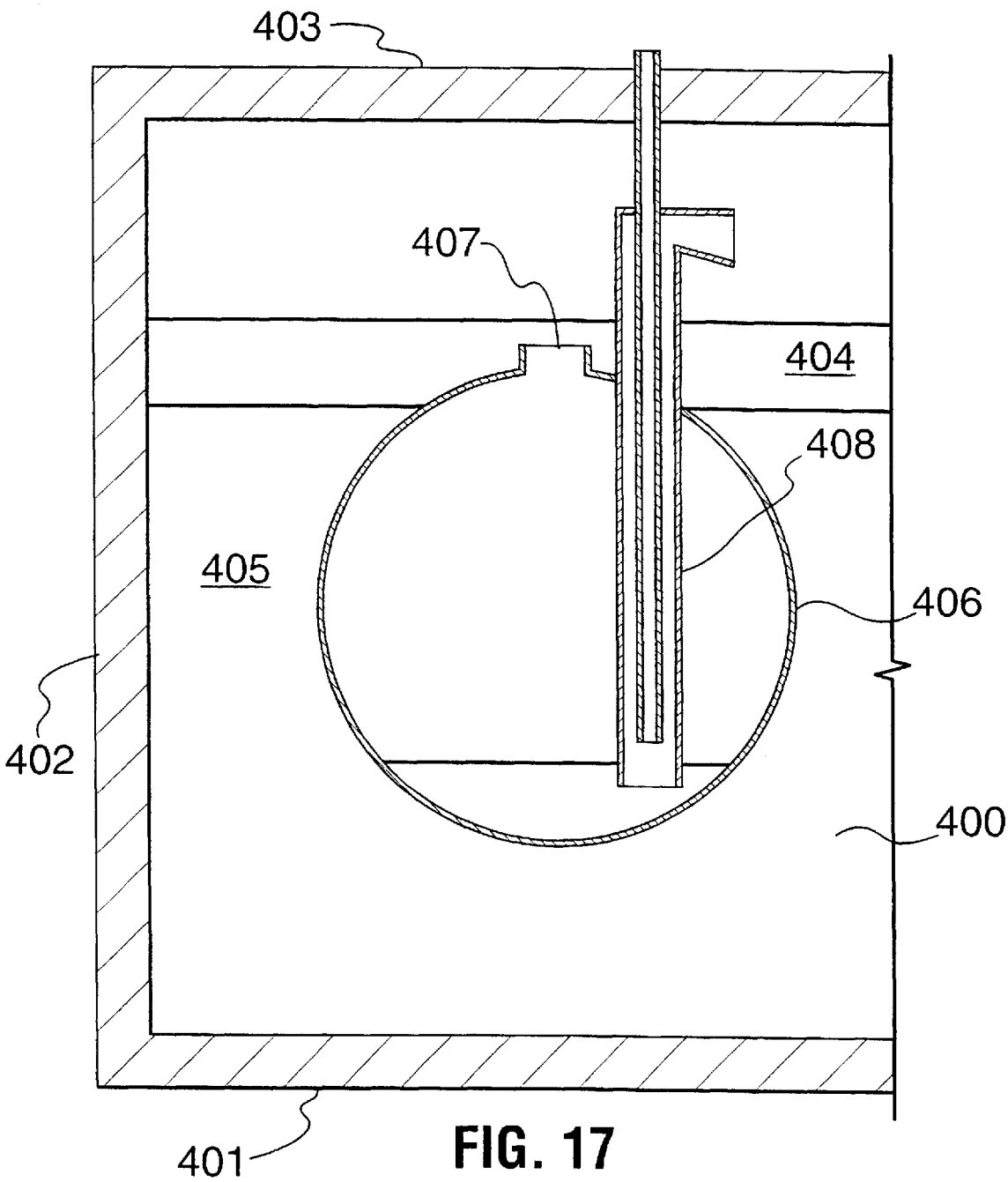
FIG. 17 is an enlarged cross-section of the metal recovery section showing an alternative design.

In FIG. 17, a portion of the metal recovery section 400 is shown, with insulated bottom wall 401, side wall 402 and an insulated top cover 403. The recovered metal forms a layer 404 on the top of the electrolyte layer 405. A metal reservoir 406 in the form of a vessel having a cylindrical cross-section with closed ends is provided and an opening 407 in the top of the vessel communicating with the metal layer 404. When desired, metal can be removed from the reservoir by inserting the inlet of a tapping crucible via opening 407 and a port (not shown) in the top cover. A pump 408 of any one of the type previously described is provided so that liquid can be removed from the reservoir and metal can thereby overflow into the reservoir as in the previous embodiments.

Figure 18:
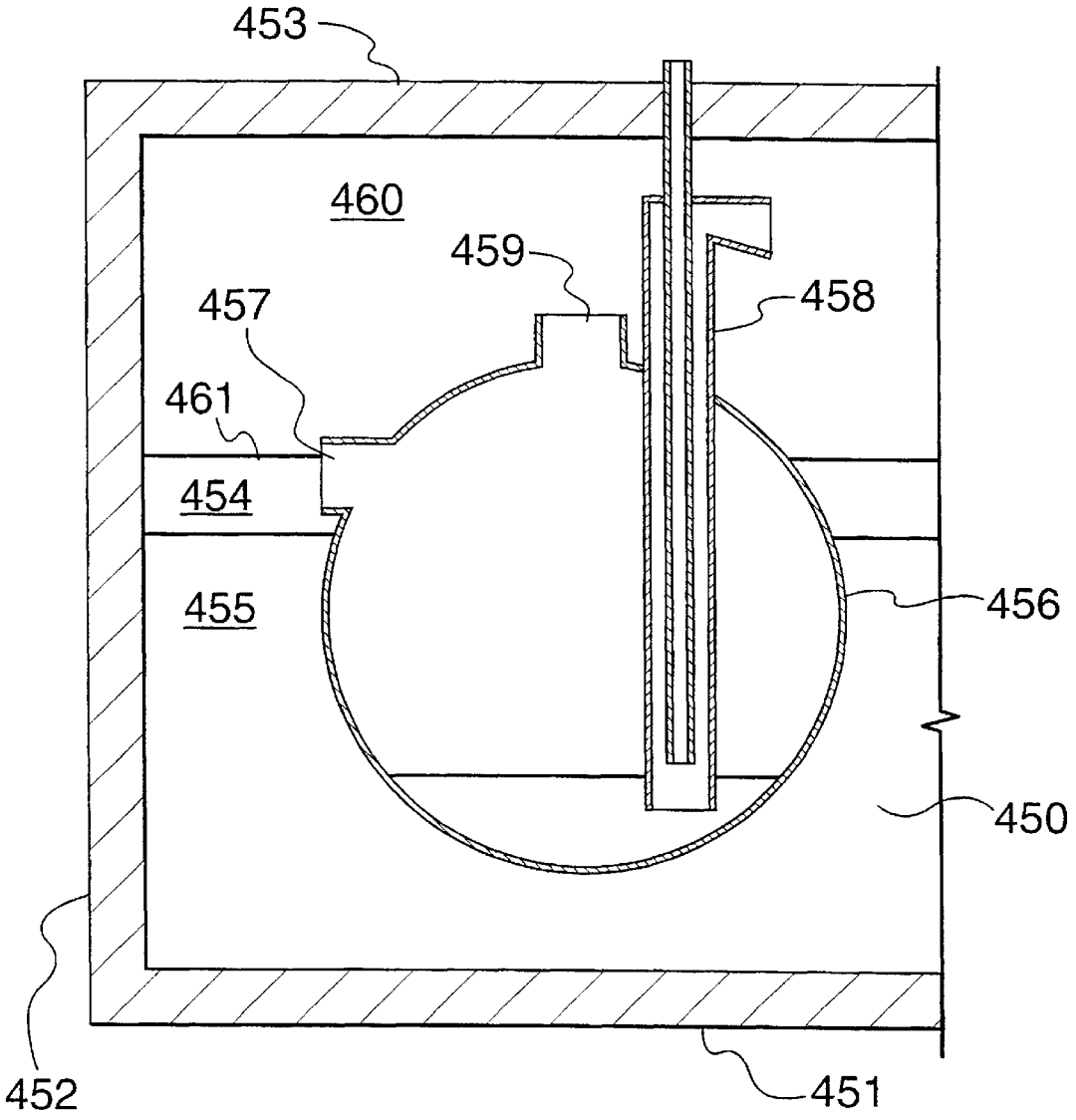
FIG. 18 is a cross-section similar to FIG. 17 showing a further modified design.

In FIG. 18, a portion of the metal recovery section 450 is shown, with insulated bottom wall 451, side wall 452 and an insulated top cover 453. The recovered metal forms a layer 454 on the top of the electrolyte layer 455. A metal reservoir 456 in the form of a vessel having a cylindrical cross-section with closed ends is provided and an opening 457 facing in a sideways direction is provided which communicates with the metal layer 454. A pump 458 of any one of the types previously described is provided. An opening 459 is provided in the top of the reservoir communicating with the gas space 460 above the metal in the metal recovery. section to equalize gas pressures between the reservoir and recovery section (if the upper surface of the metal 461 rises above the top of the opening 457) and thus ensures that the upper surface of the metal 461 inside the reservoir remains equalized with that outside the reservoir. The opening 459 also provides a means of accessing the metal in the reservoir for tapping.

Figure 19:
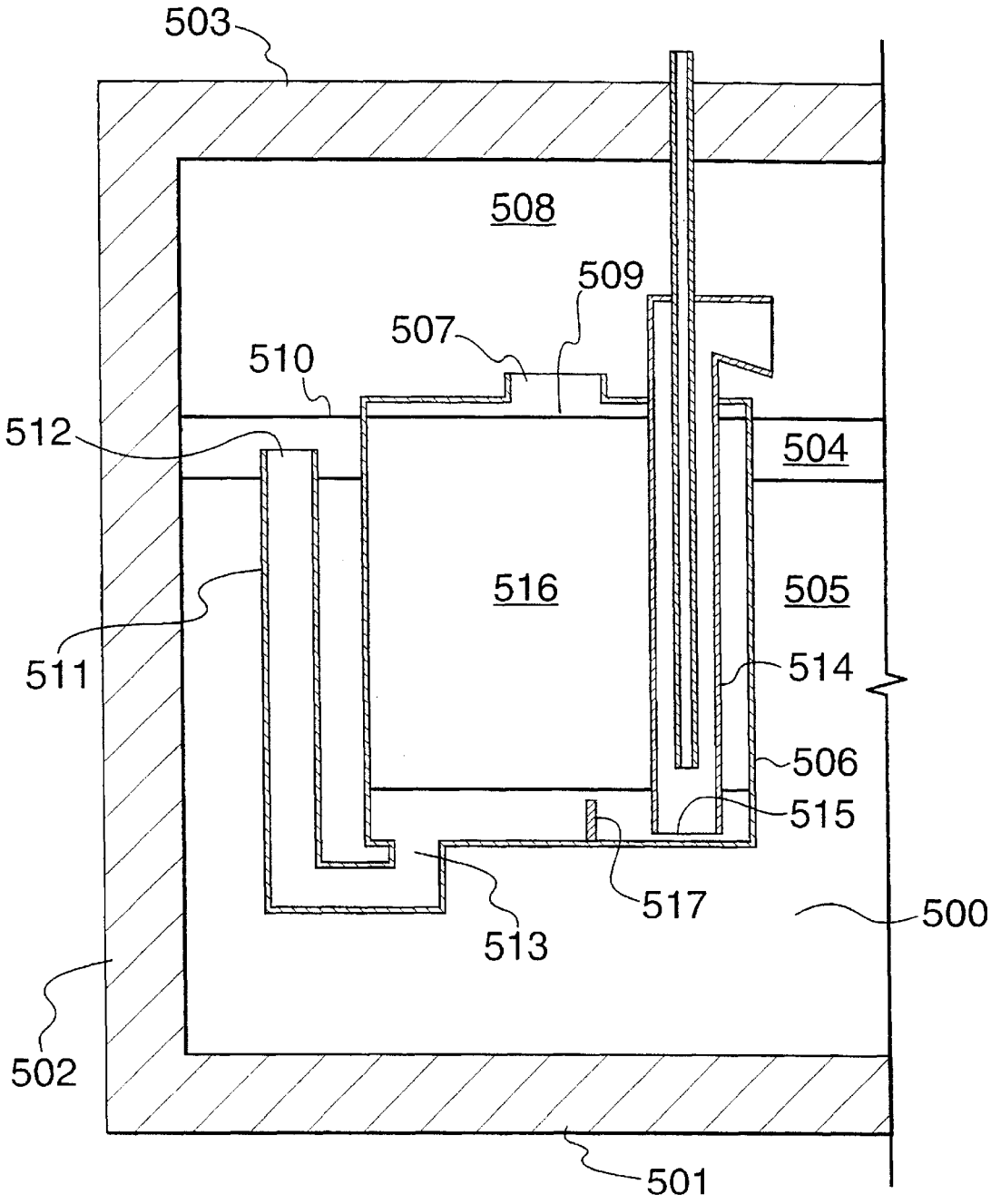
FIG. 19 is a cross-section of a portion of the metal recovery section showing an alternative means of metal flow.

In FIG. 19, a portion of the metal recovery section 500 is shown, with insulated bottom wall 501, side wall 502 and an insulated top cover 503. The recovered metal forms a layer 504 on the top of the electrolyte 505. A metal reservoir 506 in the form of a rectangular box is provided with an opening 507 in the top surface communicating with the gas space 508 above the metal recovery section to provide access for tapping the metal in the reservoir and to ensure that the upper surface of the metal in the reservoir 509 and in the metal recovery section 510 are equalized. A pipe 511 is provided with a top opening 512 communicating with the metal layer 504 and which is connected to the bottom surface of the reservoir 513. A pump 514 of any one of the types previously described is provided. The entry to the pump 515 is placed as far as possible from the pipe connection 513 to allow metal entering via the pipe into the reservoir to rise to form the layer 516 within the reservoir without being drawn immediately into the pump. A small barrier wall 517 may also be used to reduce this bypass.

What is claim is:

1. An electrolysis cell for producing a molten metal having a density less than a density of a molten electrolyte used for producing said metal in said cell, comprising:

at least one section adapted for electrolysis of a salt of said metal contained in a molten electrolyte to form droplets of said metal in molten form contained in said electrolyte;

electrodes within said at least one electrolysis section for effecting said electrolysis;

a metal recovery section adapted for separation of said metal from said electrolyte to form a molten metal layer, having an upper surface, floating on an upper surface of said molten electrolyte;

a liquid-filled reservoir communicating with an upper part of the metal recovery section adapted for the collection of molten metal from said molten metal layer by overflow of said layer into said reservoir;

liquid transfer apparatus communicating with said reservoir wherein said liquid transfer apparatus is adapted for displacement of liquid already present in the reservoir, without removing said liquid permanently from said cell, to enable molten metal from said layer to accumulate in said reservoir; and a tapping device for periodically removing metal from the cell.

2. A cell according to claim 1, characterized in that said upper surface of said molten metal layer in said recovery section is continuous with an upper surface of said molten metal in said reservoir.

3. A cell according to claim 1, characterized in that said cell has a side wall and wherein said reservoir is positioned adjacent to said side wall.

4. A cell according to claim 1, characterized in that said reservoir has a side wall adjacent to said metal recovery section and said side wall incorporates a layer of a heat insulating material.

5. A cell according to claim 1, characterized in that said liquid transfer apparatus comprises a vessel having an interior volume communicating with said reservoir and connected to an external gas supply, and gas from said gas supply may be used to move liquid from the reservoir into the vessel or, alternatively to move liquid out of said vessel into the said reservoir.

6. A cell according to claim 1, characterized in that said liquid transfer apparatus comprises means to draw liquid from said reservoir and deliver it to said metal recovery section.

7. A cell according to claim 6, characterized in that said liquid transfer apparatus is a gas lift pump, an impeller-driven draft tube, a pump in which liquid is alternately drawn into and expelled from a chamber by means of application of vacuum and gas pressure, the flow being controlled by check valves, or a centrifugal pump.

8. A cell according to claim 6, characterized in that said liquid transfer apparatus feeds a container from which said liquid is metered back into said metal recovery section.

9. A cell according to claim 1, characterized in that the said reservoir is in the form of a container having at least one opening communicating with the metal recovery section, at least part of said at least one opening lying below said upper surface of said metal layer during at least part of normal cell operations, all of said at least one opening lying above said upper surface of said electrolyte In said metal recovery section for at least part of said normal cell operations, and said container being otherwise closed to prevent the free flow of electrolyte or metal between said metal recovery section and said reservoir.

10. A cell according to claim 9, characterized in that said at least part of said at least one opening lies below said upper surface of said metal layer during all normal cell operations.

11. A cell according to claim 10, characterized in that all of said at least one opening lies above said upper surface of said electrolyte for at least 80 percent of the time that the cell operates under normal cell operations.

12. A cell according to claim 11, characterized in that all of said at least one opening lies above said upper surface of the electrolyte during all normal cell operations.

13. A cell according to claim 10, characterized in that the said at least one opening is partially above both said upper surface of said electrolyte and said upper surface of said metal layer during normal cell operation.

14. A cell according to claim 10, characterized in that said reservoir is open at a top thereof and has a solid side wall forming sides and has a solid bottom wall, wherein said side wall has an upper edge and at least one portion of said upper edge defining said at least one opening lies below said upper surface of said molten metal layer in said metal recovery section during normal cell operations, but said at least one portion of said upper edge of said side wall lies entirely above said upper surface of said electrolyte in the metal recovery section during normal cell operations.

15. A cell according to claim 14, characterized in that all of said portion of said upper edge of side wall lies below said upper surface of said metal layer during normal cell operations.

16. A cell according to claim 1, characterized in that said reservoir includes means to beat the metal in said reservoir.

17. An electrolysis cell for producing a molten metal having a density less than a density of a molten electrolyte used for producing said metal in said cell the cell having at least one section for the electrolysis of a salt of said metal contained in a molten electrolyte to form droplets of said metal in molten form contained in said electrolyte; electrodes within said at least one electrolysis section for effecting said electrolysis; a metal recovery section for separation of said metal from said electrolyte to form a molten metal layer, having an upper surface, floating on an upper surface of said molten electrolyte; a reservoir for withdrawal and temporary holding of molten metal separated from said electrolyte in said metal recovery section; and a tapping device for periodically removing molten metal from the cell;

characterized in that the said reservoir is in the form of a container having at least one opening communicating with the metal recovery section, at least part of said at least one opening lying below said upper surface of said metal layer during normal cell operations, all of said at least one opening lying above said upper surface of said electrolyte in said metal recovery section for at least part of said normal cell operations, and said container being otherwise closed to prevent the free flow of electrolyte or metal between said metal recovery section and said reservoir.

18. A cell according to claim 17, characterized in that said container has a top, sides and a bottom.

19. A cell according to claim 18, characterized in that said at least one opening forms said top of said container.

20. A cell according to claim 17, characterized in that said reservoir is a sealed container with said opening in the form of a stand-pipe communicating with a metal pad in said recovery section and extending inside the reservoir to a point near the bottom surface of the reservoir; and a gas inlet is sealed to said container and fed from a pressure controller; a level sensor is provided to sense the position of the-said upper surface; and control means is provided to cause said pressure controller to admit or exhaust gas from said container such that said position of said upper surface is maintained at a predetermined position during cell operations.

21. A process of producing a metal, in which a salt of said metal contained in a molten electrolyte is electrolysed in an electrolysis section of an electrolysis cell to produce a mixture of molten metal and molten electrolyte; the mixture is conveyed to a metal recovery section of said cell and the metal and electrolyte are allowed to separate into layers in the metal recovery section, said metal in molten form having a density that is less than the said molten electrolyte; molten electrolyte from the metal recovery section is recirculated to the electrolysis section; and molten metal is periodically removed from the cell; characterized in that the process includes providing a liquid-filled reservoir communicating with an upper part of the metal recovery section for the collection of molten metal from said molten metal layer by overflow of said layer into said reservoir and liquid transfer apparatus communicating with said reservoir; and the liquid transfer apparatus displaces liquid already present in said reservoir to enable molten metal from said layer to accumulate in said reservoir, without removing said liquid permanently from said cell.

22. A process according to claim 21, characterized in that an upper surface of said molten metal layer in said recovery section is kept continuous with an upper surface of said molten metal in said reservoir.

23. A process of producing a metal, in which a salt of said metal contained in a molten electrolyte is electrolysed in an electrolysis section of an electrolysis cell to produce a mixture of molten metal and molten electrolyte; the mixture is conveyed to a metal recovery section of said cell and the metal and electrolyte are allowed to separate into layers in the metal recovery section, said metal in molten form having a density that is less than the said molten electrolyte; molten electrolyte from the metal recovery section is recirculated to the electrolysis section; and molten metal is periodically removed from the cell, characterized in that the process includes providing a molten metal reservoir in the cell in the form of a container having at least one opening communicating with the metal recovery section, and maintaining an upper surface of said metal layer in said metal recovery section above at least part of said at least one opening during normal cell operations, maintaining an upper surface of said electrolyte in said metal recovery section below all of said at least one opening for at least part of normal cell operations, and where electrolyte or metal cannot otherwise freely flow through the said sides or said bottom between the said metal recovery section and said reservoir.

24. A process according to claim 23, characterized in that said reservoir has a top, sides and a bottom.

25. A process according to claim 23, characterized in that liquid in said reservoir is periodically removed from the reservoir without permanently removing the said liquid from said electrolysis cell to cause said molten metal to flow into said molten metal reservoir.

26. A process according to claim 23, characterized in that said reservoir is a sealed container with said opening in the form of a stand-pipe communicating with a metal pad in said recovery section and extending inside the reservoir to a point near the bottom surface of the reservoir; and gas is fed to said container through a sealed inlet from a pressure controller, the upper surface is sensed by a level sensor and a control means is operated to cause said pressure controller to admit or exhaust gas from said container such that said position of said upper surface is maintained at a predetermined position during cell operations.

* * * * *